US005878928A

United States Patent [19]

Seiber

[11] Patent Number: 5,878,928

[45] Date of Patent: Mar. 9, 1999

[54] WOLFPACK

[76] Inventor: Don Seiber, 11545 Yarnell Rd., Knoxville, Tenn. 37932

[21] Appl. No.: 944,610

[22] Filed: Oct. 6, 1997

Related U.S. Application Data

[63] Continuation-in-part of Ser. No. 337,863, Nov. 14, 1994, abandoned.

[51] Int. Cl.[6] ..... A45F 4/02; A45F 3/08

[52] U.S. Cl. ..... 224/153; 224/155; 224/579; 224/631; 224/629; 224/637; 224/652; 224/653; 224/654; 4/602; 4/484

[58] Field of Search ..... 224/631, 632, 224/629, 628, 637, 652, 653, 654, 753, 155, 579; 4/602, 484

[56] References Cited

U.S. PATENT DOCUMENTS

| | | | |
|---|---|---|---|
| 4,582,165 | 4/1986 | Latini | 224/155 |
| 4,874,119 | 10/1989 | Winter | 224/629 |
| 5,016,792 | 5/1991 | Jay | 224/155 |

FOREIGN PATENT DOCUMENTS

| | | | |
|---|---|---|---|
| 248 098 | 6/1912 | Germany | 224/209 |
| 182 847 | 5/1936 | Switzerland | 224/209 |
| 2023 412 | 1/1980 | United Kingdom | 224/155 |
| 9419985 | 9/1994 | WIPO | 224/211 |

*Primary Examiner*—Linda J. Sholl

[57] ABSTRACT

A hard-shelled backpack that consists of opposing outer doors, removable interlocking compartments, detachable outer pockets, dual purpose shoulder straps, a multipurpose frame, and dual purpose cargo bags, as-well-as a unique hip suspension device that allows the wearer to adjust and alter the weight of the backpack in reference to the body. This device changes the position of the backpack in reference to the body through an articulating ratchet device that subsequently changes the physical work that a given muscle group performs on any given terrain. The device is controlled by a dial directly behind the waistline of the wearer and is adjustable to the desires of the individual. The outer doors open in an opposing manner in relation to each other. This function allows access to all equipment contained therein. The interlocking compartments are easily removed to allow access to less used equipment. The outer pockets of this backpack once detached from the bulk of the pack may be combined to form a bag designed for the storage of food while camping. Both shoulder straps are detachable and then unfold for an alternate use. One as a water reservoir and the other as a fanny pack; both may be used on day hikes. The frame of the pack is removable and then may be unfolded to reveal a device designed to be sat upon such as a chair. This device may also be used as a toilet with a disposable plastic trash bag. Two cargo bags, one for the storage of a sleeping bag and the other for storage of clothes on the pack during transport; once emptied maybe unzipped to reveal an alternate bag built inside the liner of the first, designed specifically to hold water, that provides a heated shower system when combined or used with other components.

9 Claims, 20 Drawing Sheets

WOLFPACK

This is a continuation-in-part of Ser. No. 08/337,863 filed on Nov. 14, 1994 now abandoned.

BACKGROUND OF INVENTION

1. Field of Invention

This invention relates to backpacks, and more specifically to a hard shell backpack that includes a chair that can also be used as a toilet and includes a water heating system that provides a heated shower that is adjustable in temperature containing both hot and cold attributes.

2. Prior Art

Most backpacks are made of some kind of material such as cloth with a frame consisting of either aluminum or a light steel with few exceptions. Some offer some kind of sitting device as seen in U.S. Pat. No. 4,530,451 wherein a storage bag is attached to a foldable chair frame and to U.S. Pat. No. 5,016,792 wherein the frame of the pack converts to a beach type chair. U.S. Pat. No. 4,487,345 shows a typical wooden chair with a container attached to its backside. U.S. Pat. No. 3,307,758 shows a bag and backrest that includes ropes to hold the seat and back together. U.S. Pat. No. 3,662,932 shows a box like pack that converts to a stool. The frame must be unscrewed from the pack and then reattached to form the legs of the stool. U.S. Pat. No. 4,286,739 shows a frame set up which when collapsed may act as a backpack and when unfolded makes a chair with a bag hanging from the side rails of the pack. U.S. Pat. No. 4,582,165 shows a frame of a backpack that once the pack is removed from the frame the seat can be attached to a tree for support. U.K. Pat. 2,023,412 shows a rigid shell backpack that can be set upon.

Swiss Patent 182,847 shows a backpack with multiple compartments. WIPO Patent 094019985 shows a backpack that has multiple compartments that can be removed from the hard frame of the pack. German Patent 248098 shows a backpack that also has multiple compartments based on a flat rigid back.

U.S. Pat. No. 4,874,119 shows a backpack that has hinges on the top and sides of the pack to allow access to the inside of the pack.

Although these packs conform in to some kind of sitting device through various means all differ from the present invention. None of these have the present configuration that may be used as a toilet nor do they have a heated shower. It is the intention of this invention to be more elegant, more comfortable and more luxurious than known in the prior art.

BRIEF SUMMARY

This invention pertains to the backpacking industry. This particular design differs from other pack designs in that it is constructed of plastic, therefore having a rigid outer shell. It is designed to carry an array of specific equipment each contained in a predefined pocket. The frame of the pack is adjustable in one inch increments to alter the overall length of the unit so as to more comfortably fit a human body regardless of their height. The frame is also attached to a unique hip suspension device far more adjustable than has been known in previous designs. The frame can also be removed from the bulk of the pack. Once the hip suspension is removed the frame's form can be unfolded to reveal a device that can be set upon such as a chair. This device may also be used as a toilet with a disposable plastic trash bag. Two dual use cargo bags comprise both the top and bottom ends of the backpack, one is for the storage during transport of a sleeping bag and the second is for the transport of clothes. Both bags used in this manner resemble common stuff bags. Both bags once emptied, may be unzipped to reveal water reservoirs constructed within their liners. One reservoir, once filled with water, may be used with other equipment provided to heat the water within. The other reservoir contains water of natural temperature being cool. Both reservoirs used together provide a heated shower that is adjustable in temperature.

BRIEF DESCRIPTION OF DRAWINGS

The distinctiveness and concept of this backpack which is convenience through itemization and efficiency through serving two or more functions with a given component such as the frame/chair/toilet, dual purpose outer pockets, shoulder straps and cargo bags should become increasingly more evident upon the understanding derived from viewing these figures.

DETAIL DESCRIPTION OF DRAWING

Figure 1:
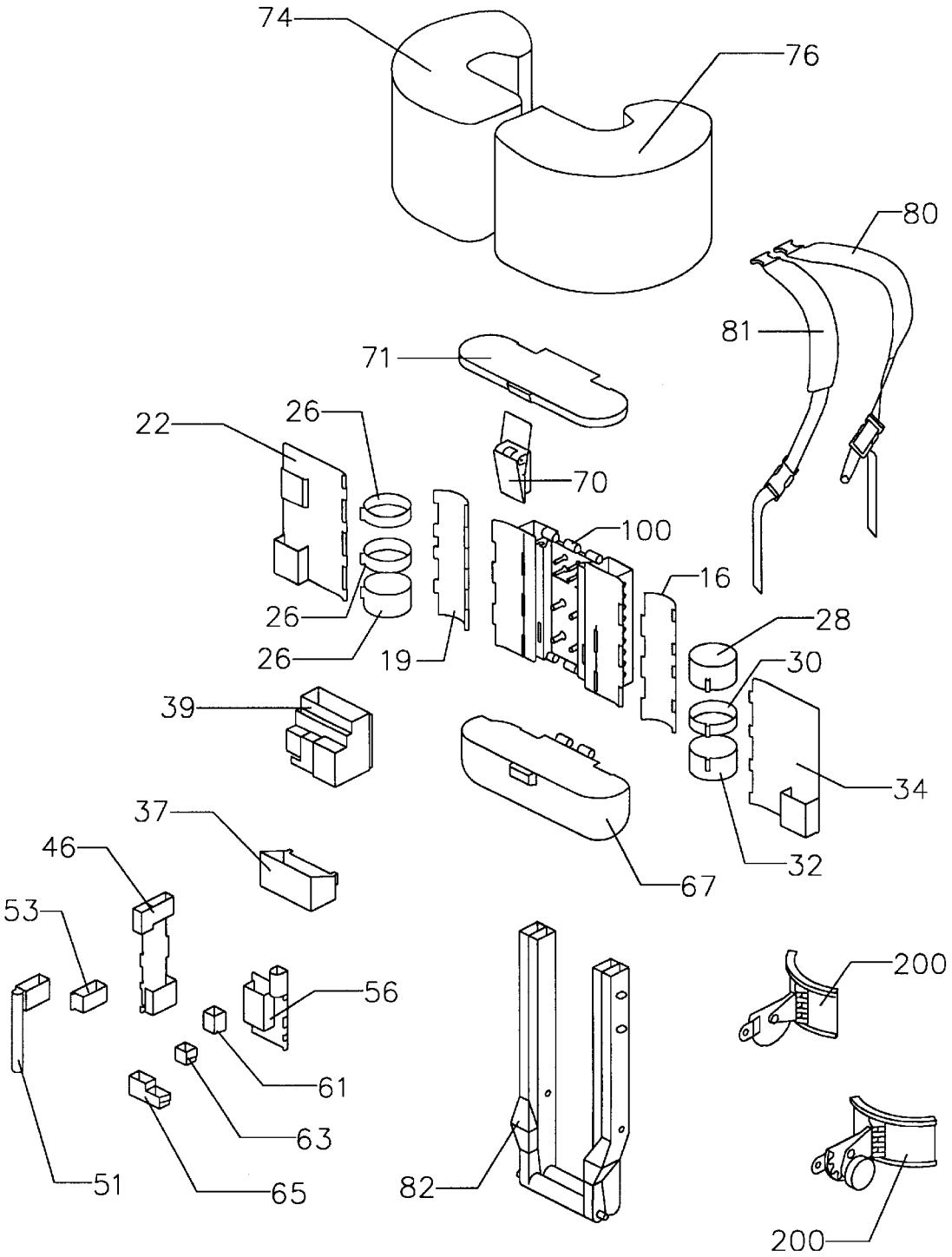
FIG. 1 is of components that serve to makeup the body of the backpack.

Referring now to the drawings in detail, FIG. 1 is an overview of components that serve to make up the body of the backpack.

Figure 2A:
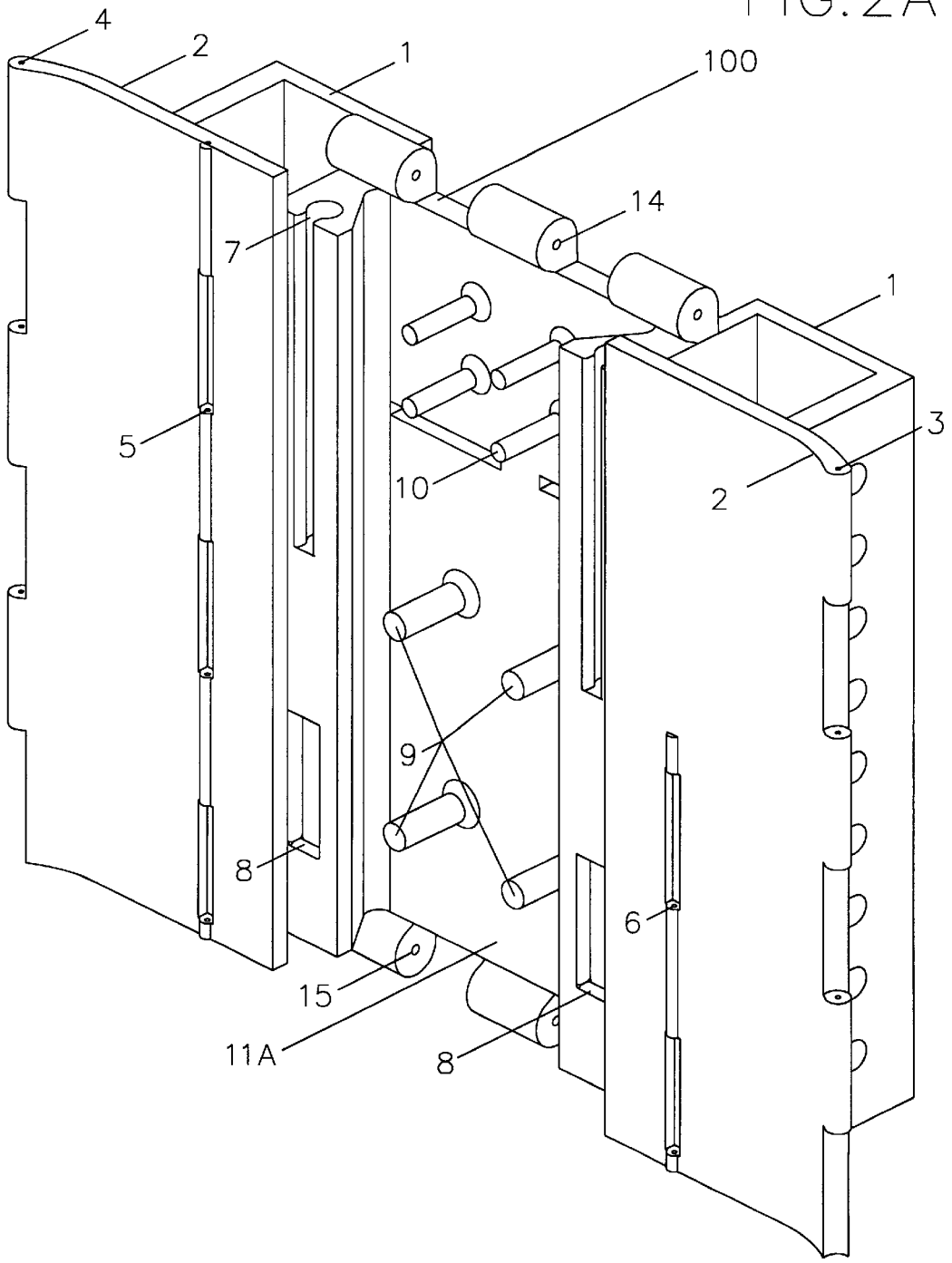
FIGS. 2A and 2B are of the main hull which serves as a base structure upon which other components are assembled.

As seen in FIG. 2A, the base of the backpack is formed by a main hull (100). The main hull (100) consists of backrests (1) that rest against the back of the user for comfort and are connected together by a panel member (11A). The main hull (100) includes left and right side-walls (2) serving as structural mounts for inner doors, outer shells, and interlocking compartments which are described in detail later. The left and right side-walls (2) include right and left outer shell structural mounts (3,4), respectively, which allow the outer shells to be pivotally connected to the main hull (100). The left and right side-walls (2) also includes left and right inner door structural mounts (5,6), respectively, that allow inner doors to be pivotally connected to the main hull (100). The main hull (100) further includes upper and lower slides (7,8), respectively, for allowing releasable attachment of upper and lower interlocking compartments that are described in detail later. The main hull (100) is also provided with pins (9,10) used for wrapping large or small cords such that they may be transported on the back. The main hull (100) also includes structural mounts (14,15) for attaching in a pivotal manner top and bottom lids (described in detail later), respectively.

Figure 2B:
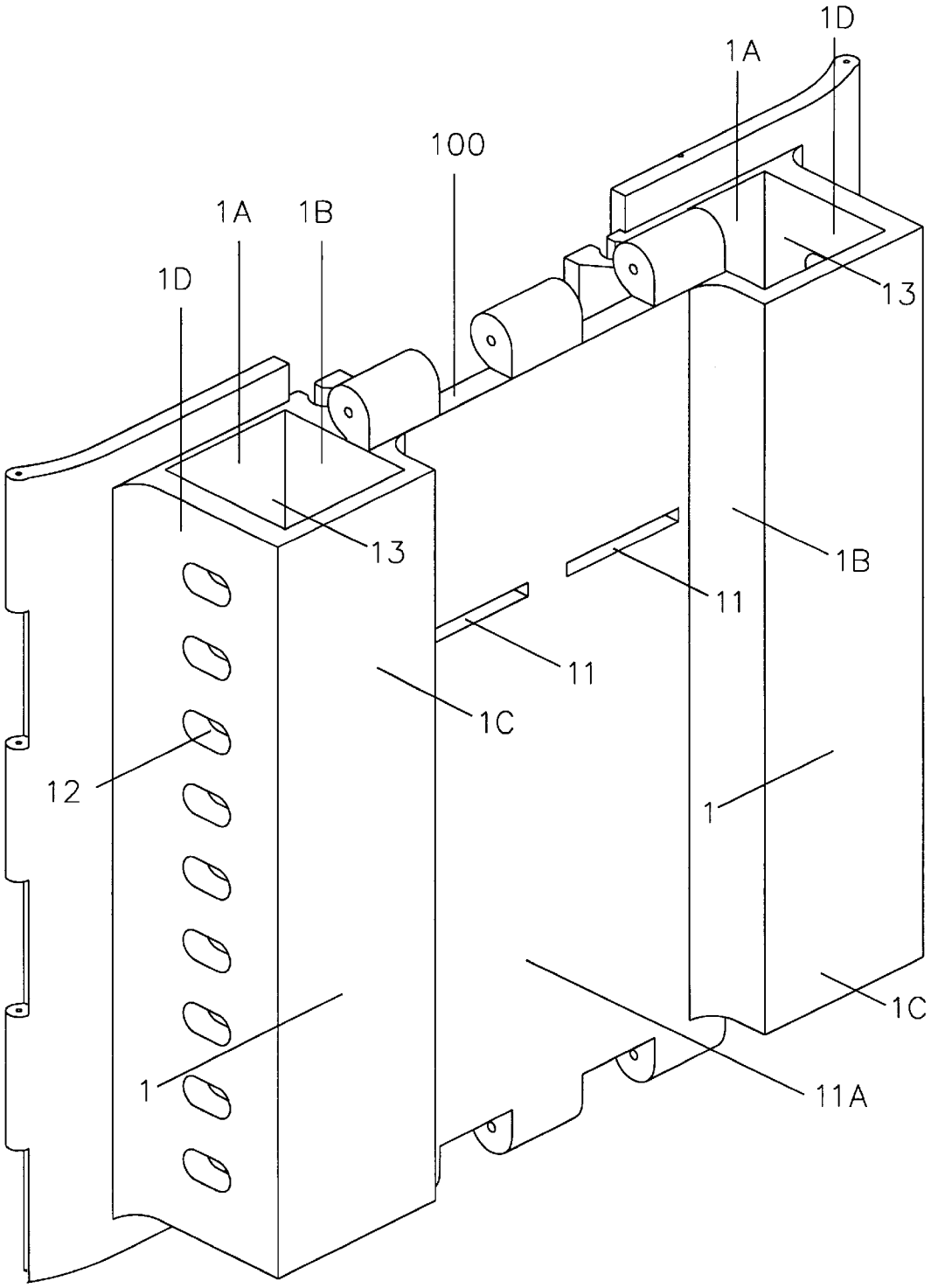

The back of the main hull (100) as seen in FIG. 2B, shows areas by which shoulder straps and a frame (described in detail later) are releasably attached to the main hull (100). The main hull (100) provides a passable means through areas (II) to the upper ends of the shoulder straps (described in detail later) for such attachment as the backpack would be transported on the back. The main hull (100) further includes a tubular opening (13) formed by walls of the backrest (1A–1D) for insertion of a frame (described in detail later) as it would be transported on the back. The main hull (100) also provides adjustments for a frame through apertures (12) on wall (1D) to better fit the human body, this is described in further detail later.

Figure 3:
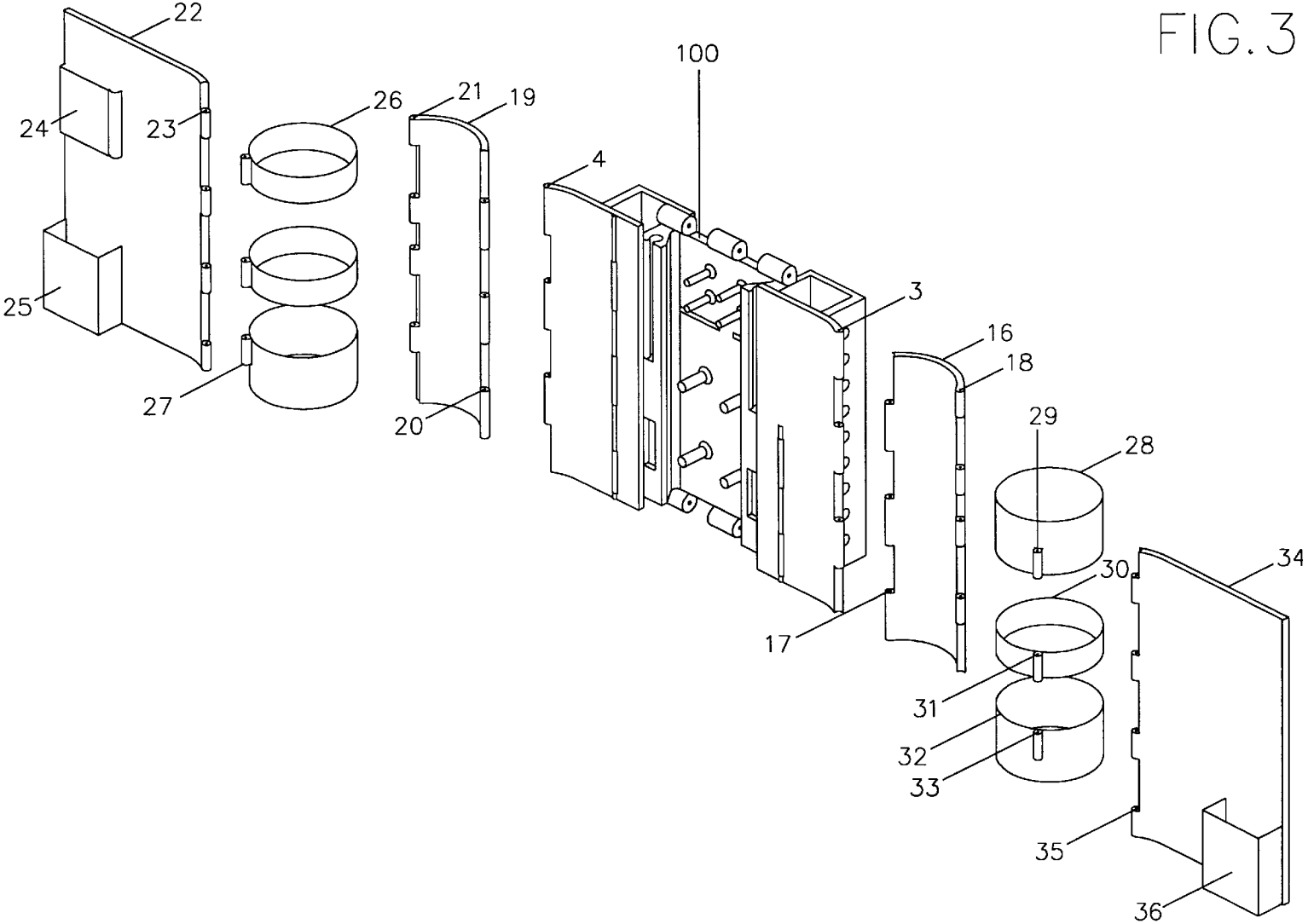
FIG. 3 is of the main hull and all components to both the immediate right and left of it.

The components as seen in FIG. 3 are to both the immediate right and left of the main hull (100). The right and left outer shells (16,19), respectively, allow the main hull (100) to be pivotally connected to the right and left outer doors (described in detail later), respectively. The right outer shell (16) is equipped with left and right side structural mounts (17,18), respectively. The left side structural mounts (17) allows the right outer shell (16) to be pivotally connected to the main hull (100) by use of the right outer shell structural mounts (3). The right side structural mounts (18) allow the right outer shell (16) to be pivotally connected to the right outer door described later. The left outer shell (19) is equipped with right and left side structural mounts (20,21) respectively. The right side structural mounts (20) allow the left outer shell (19) to be pivotally connected to the main hull (100) by use of the left outer shell structural mounts (4). The left side structural mounts (21) allow the left outer shell (19) to be pivotally connected to the left outer door described later.

The right and left outer doors (34,22), respectively, allow inner cylinders (described in detail later) to be pivotally connected to the right and left outer shells (16,19), respectively. The right outer door (34) includes left side structural mounts (35). The left side structural mounts (35) allow the right outer door (34) to be pivotally connected to the right outer shell (16) by use of the right side structural mounts (18), as-well-as as the right inner cylinders described later. The right outer door (34) includes a pocket (36) which holds equipment as it would be transported on the back. The left outer door (22) includes right side structural mounts (23). The right side structural mounts (23) allow the left outer door (22) to be pivotally connected to the left outer shell (19) by use of the left side structural mounts (21), as-well-as the left inner cylinders described later. The left outer door (22) includes upper and lower pockets (24,25), respectively. Both the upper pocket (24) and the lower pocket (25) hold equipment as it would be transported on the back.

The right upper inner cylinder, the right middle inner cylinder, and the right lower inner cylinders (28,30,32), respectively, serve as pivotally connected pockets which contain equipment such as it would be transported on the back. The right upper inner cylinder (28) includes a structural mount (29). The structural mount (29) allow the right upper inner cylinder (28) to be pivotally connected to the right outer shell (16) by use of the right side structural mounts (18) and to the right outer door (34) by use of the left side structural mounts (35). The right middle inner cylinder (30) includes a structural mount (31). The structural mount (31) allow the right middle inner cylinder (30) to be pivotally connected to the right outer shell (16) by use of the right side structural mounts (18) and to the right outer door (34) by use of the left side structural mounts (35). The right lower inner cylinder (32) includes a structural mount (33). The structural mount (33) allow the right lower inner cylinder (32) to be pivotally connected to the right outer shell (16) by use of the right side structural mounts (18) and to the right outer door (34) by use of the left side structural mounts (35). The left inner cylinders (26), although in three pieces, serves as one large pivotally connected pocket which contains equipment such as it would be transported on the back. The left inner cylinders (26) includes structural mounts (27). The structural mounts (27) allows the left inner cylinders (26) to be pivotally connected to the left outer shell (19) by use of the left side structural mounts (21) and to the left outer door (22) by use of the right side structural mounts (23).

Figure 4:
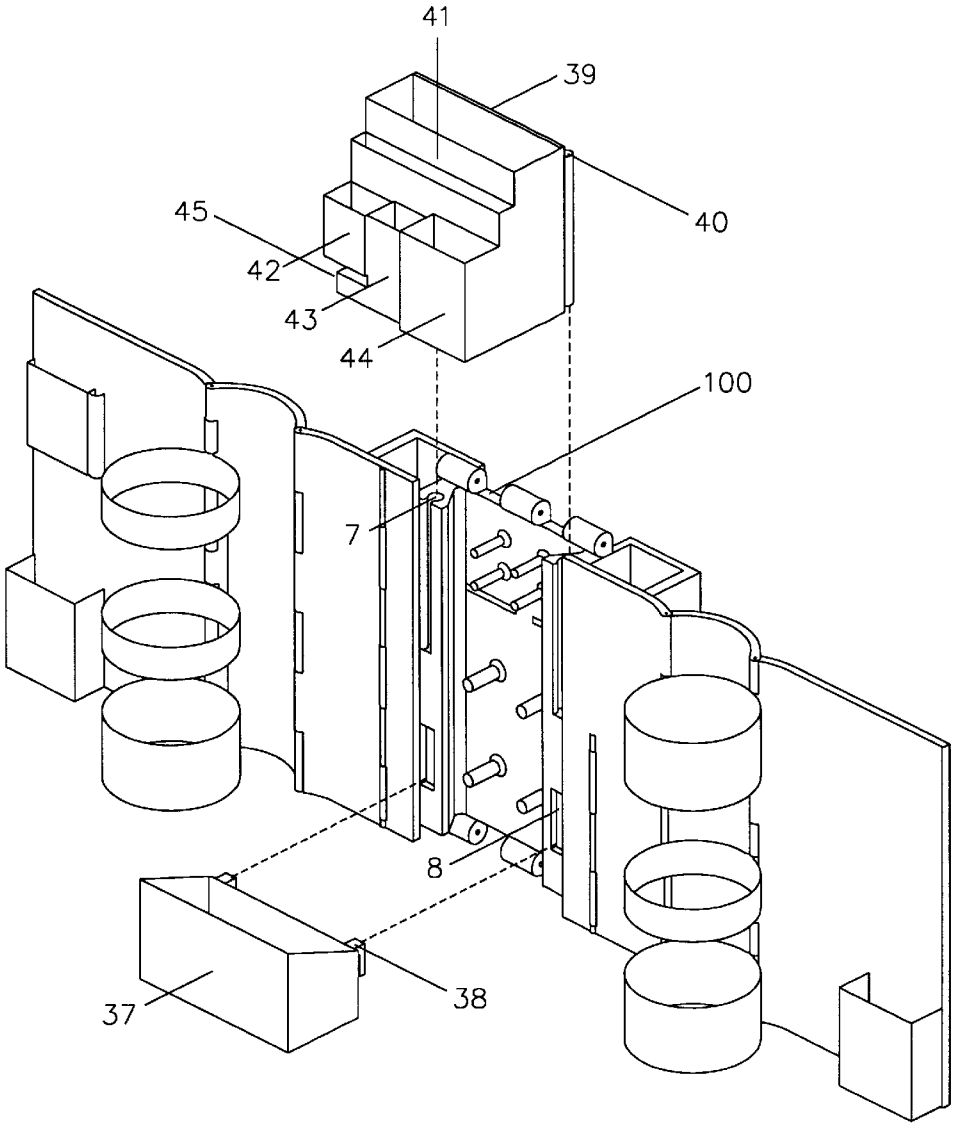
FIG. 4 shows the interlocking compartments and their relative position to the main hull.

Seen in FIG. 4 are the components to both the immediate right and left of the main hull (100) assembled. The upper and lower interlocking compartments (39,37), respectively, are illustrated. Both the upper interlocking compartment (39) and the lower interlocking compartment (37) are pockets capable of releasable attachment to the main hull (100). The upper interlocking compartment (39) includes structural slides (40). The structural slides (40) allow the upper interlocking compartment (39) to be attached and detached to and from the main hull (100) by use of the upper slides (7). The upper interlocking compartment (39) further includes pockets (41,42,43,44 and 45) which hold equipment as it would be transported on the back. The lower interlocking compartment (37), is within itself a pocket. The lower interlocking compartment (37) includes structural slides (38). The structural slides (38) allow the lower interlocking compartment (37) to be attached and detached to and from the main hull (100) by use of the lower slides (8).

Figure 5:
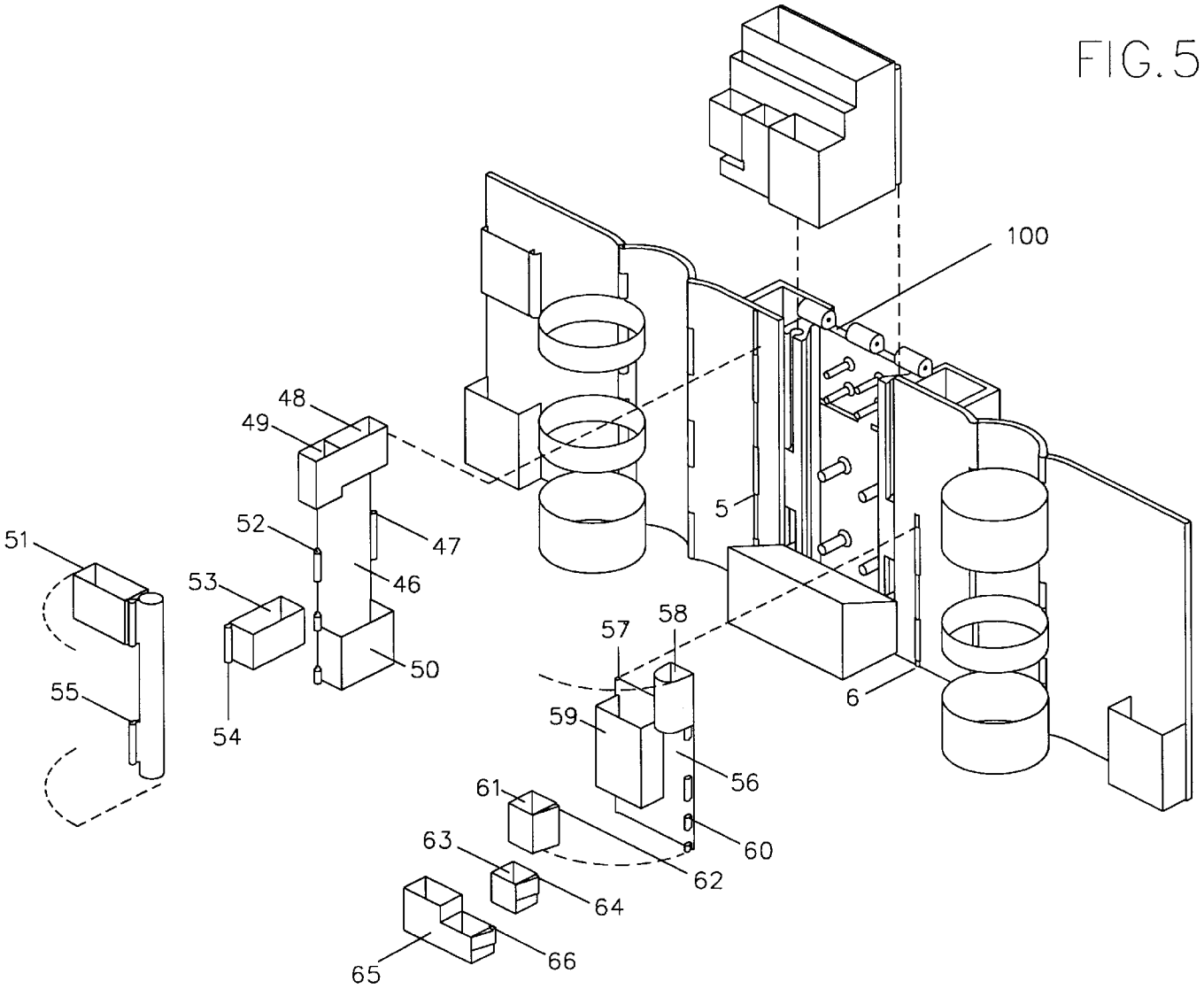
FIG. 5 shows the inner doors and their components in relative position to the main hull.

As seen in FIG. 5 the base components of the inner doors and the entities that comprise them are illustrated. The right and left inner doors (56,46), respectively, are a correlation of pivotally connected pockets. Both the right inner door (56) and the left inner door (46) are designed to contain equipment as it would be transported on the back. The right inner door (56) is equipped with inner and outer structural mounts (57,60), respectively.

The inner structural mounts (57) allow the right inner door (56) to be pivotally connected to the main hull (100) by use of the right inner door structural mounts (6). The right inner door (56) also includes outer structural mounts (60). The outer structural mounts (60) allow the right inner door (56) to be pivotally connected to pockets. The upper, middle, and lower pockets (61,63,65), respectively, are all equipped with a structural mount each. The upper pocket (61) includes a structural mount (62). The structural mount (62) allow the upper pocket (61) to be pivotally connected to the right inner door (56) by use of the outer structural mounts (60). The middle pocket (63) includes a structural mount (64). The structural mount (64) allows the middle pocket (63) to be pivotally connected to the right inner door (56) by use of the outer structural mounts (60). The lower pocket (65) includes a structural mount (66). The structural mount (66) allows the lower pocket (65) to be pivotally connected to the right inner door (56) by use of the outer structural mounts (60). The right inner door (56) further includes pockets (58,59). The pockets (58,59) are stationary on the right inner door (56) and contain equipment as it would be transported on the back. The left inner door (46) is equipped with inner and outer structural mounts (47,52), respectively. The inner structural mounts (47) allow the left inner door (46) to be pivotally connected to the main hull (100) by use of the left inner door structural mounts (5). The left inner door (46) also includes outer structural mounts (52). The outer structural mounts (52) allow the left inner door (46) to be pivotally connected to pockets. The upper and middle pockets (51,53), respectively, are both equipped with structural mounts. The upper pocket (51) includes structural mounts (55). The structural mounts (55) allow the upper pocket (51) to be pivotally connected to the left inner door (46) by use of the outer structural mounts (52). The middle pocket (53) includes a structural mount (54). The structural mount (54) allows the middle pocket (53) to be pivotally connected to the left inner door (46) by use of the outer structural mounts (52). The left inner door (46) further includes pockets (48,49 and 50). The pockets (48,49 and 50) are stationary on the left inner door (46) and contain equipment as it would be transported on the back.

Figure 6A:
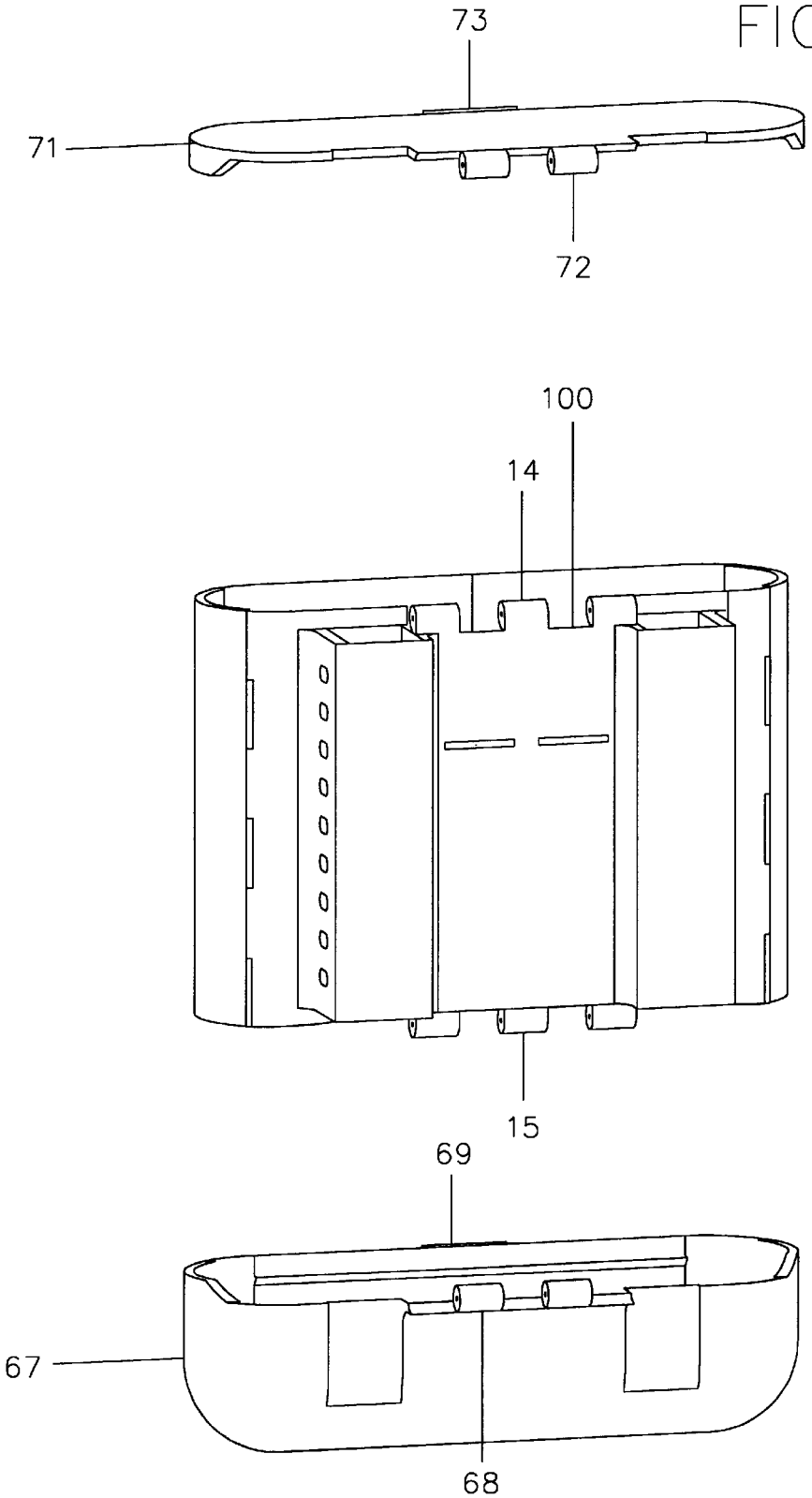
FIGS. 6A and 6B shows both the top and bottom lids and their relative position to the main hull.

As seen in FIG. 6A, a rear view of both the top and bottom lids (71,67), respectively, which comprise their respective ends of the backpack. The top lid (71) includes structural mounts (72). The structural mounts (72) allow the top lid (71) to be pivotally connected to the main hull (100) by use of the structural mounts (14). The bottom lid (67) includes structural mounts (68). The structural mounts (68) allow the bottom lid (67) to be pivotally connected to the main hull (100) by use of the structural mounts (15).

Figure 6B:
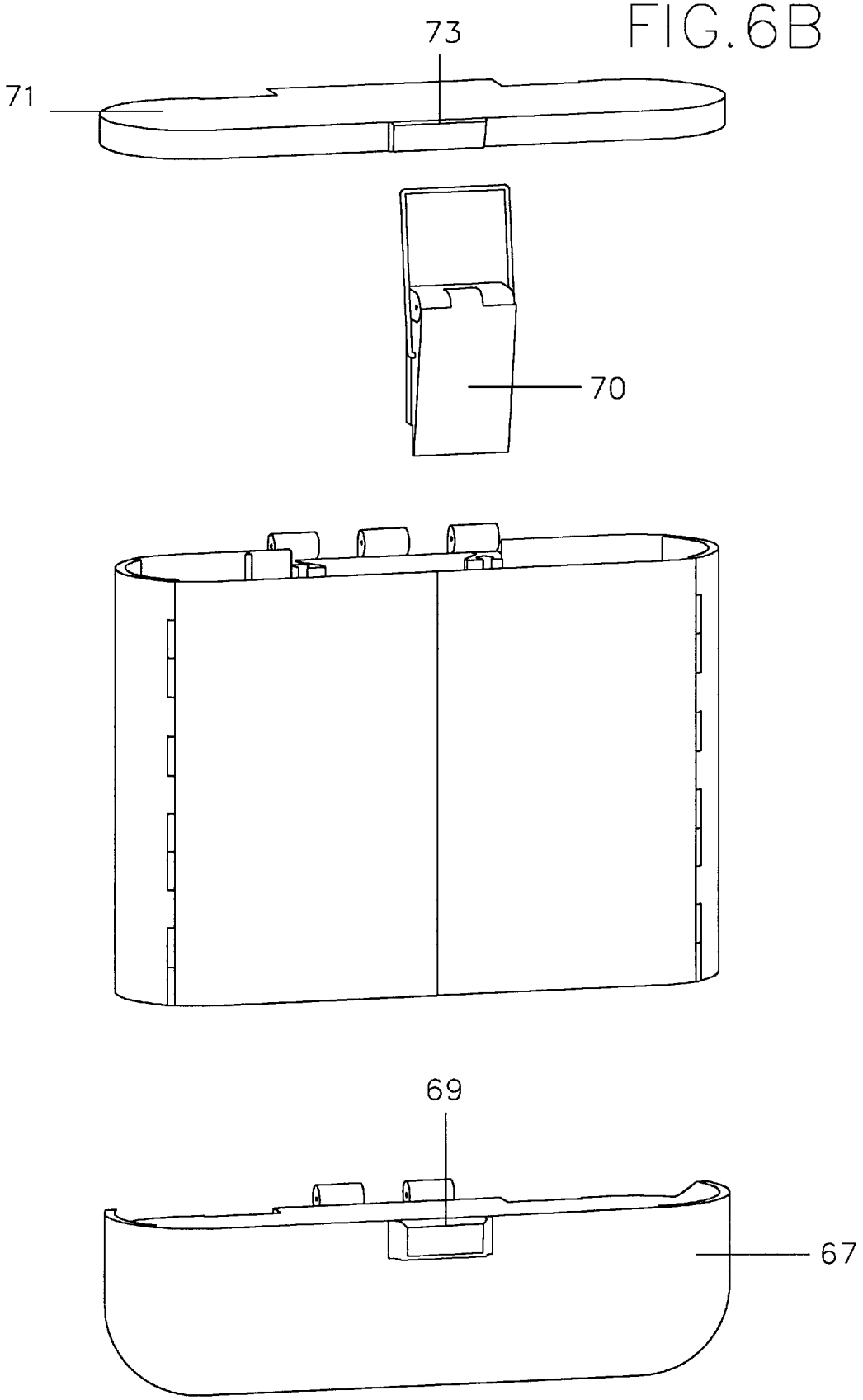

As seen in FIG. 6B, a front view of both the top lid (71) and bottom lid (67) with a buckle (70) for locking both lids together. Both the top lid (71) and the bottom lid (67) include a structural mount to allow both lids to be connected to the buckle (70). The buckle (70) contains the means to lock the entire unit together as the backpack would be carried on the back. The top lid (71) further includes a lock grove (73). The top of the buckle (70) is releasably attached to the top lid (71) by laying over the lock grove (73). The bottom lid (67) further includes a strap mount (69). The strap mount (69) allows the bottom lid (67) to be attached to the bottom of the buckle (70) through the means of a strap, (deleted for the purpose of viewing the strap mount (69)).

Figure 7A:
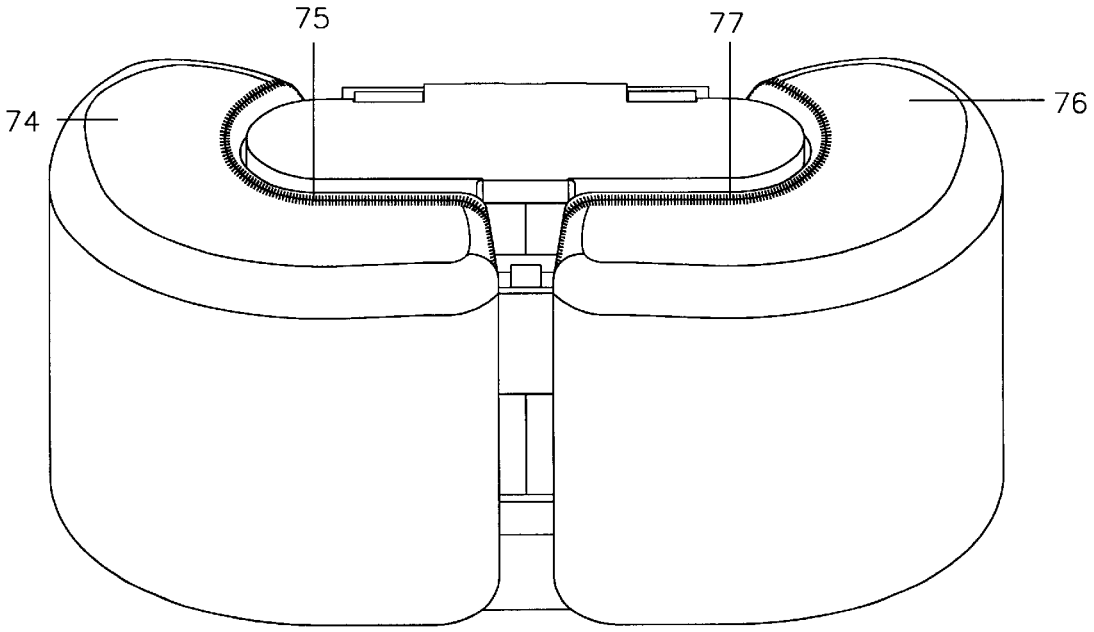
FIGS. 7A and 7B shows the outer pockets and their alternate use.

As seen in FIG. 7A a front view of the outer pockets attached to the backpack. The right and left outer pockets (76,74), respectively, are capable of releasable attachment to and from the backpack. Both the right outer pocket (76) and the left outer pocket (74) are sewn to one side of the right and left zippers (77,75), respectively. Both the right zipper (77) and the left zipper (75) are attached to their respective pockets as-well-as to the outer most right and left surfaces of the pack, respectively. One side of the right zipper (77) is sewn to the right outer pocket (76), the other side of the right zipper (77) is attached to the outer most right surface of the backpack. The right zipper (77) allows the right outer pocket (76) to be zipped on to and unzipped from the backpack. One side of the left zipper (75) is sewn to the left outer pocket (74), the other side of the left zipper (75) is attached to the outer most left surface of the backpack. The left zipper (75) allows the left outer pocket (74) to be zipped on to and unzipped from the backpack.

Figure 7B:
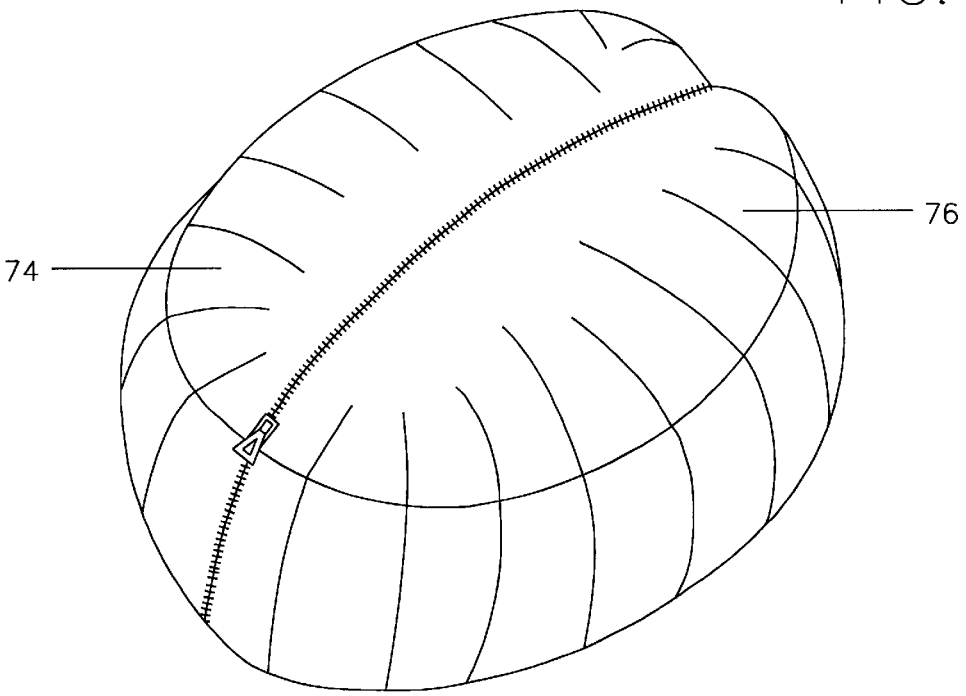

As seen in FIG. 7B a front view of the right and left outer pockets (76,74), respectively, are unzipped from the backpack and zipped together. The right outer pocket (76) and the left outer pocket (74) are detached from the backpack through the means of their respective zippers. The right outer pocket (76) and the left outer pocket (74) are then zipped together (though the means of their respective zippers) to form a sack designed for the storage of food while camping.

Figure 7C:
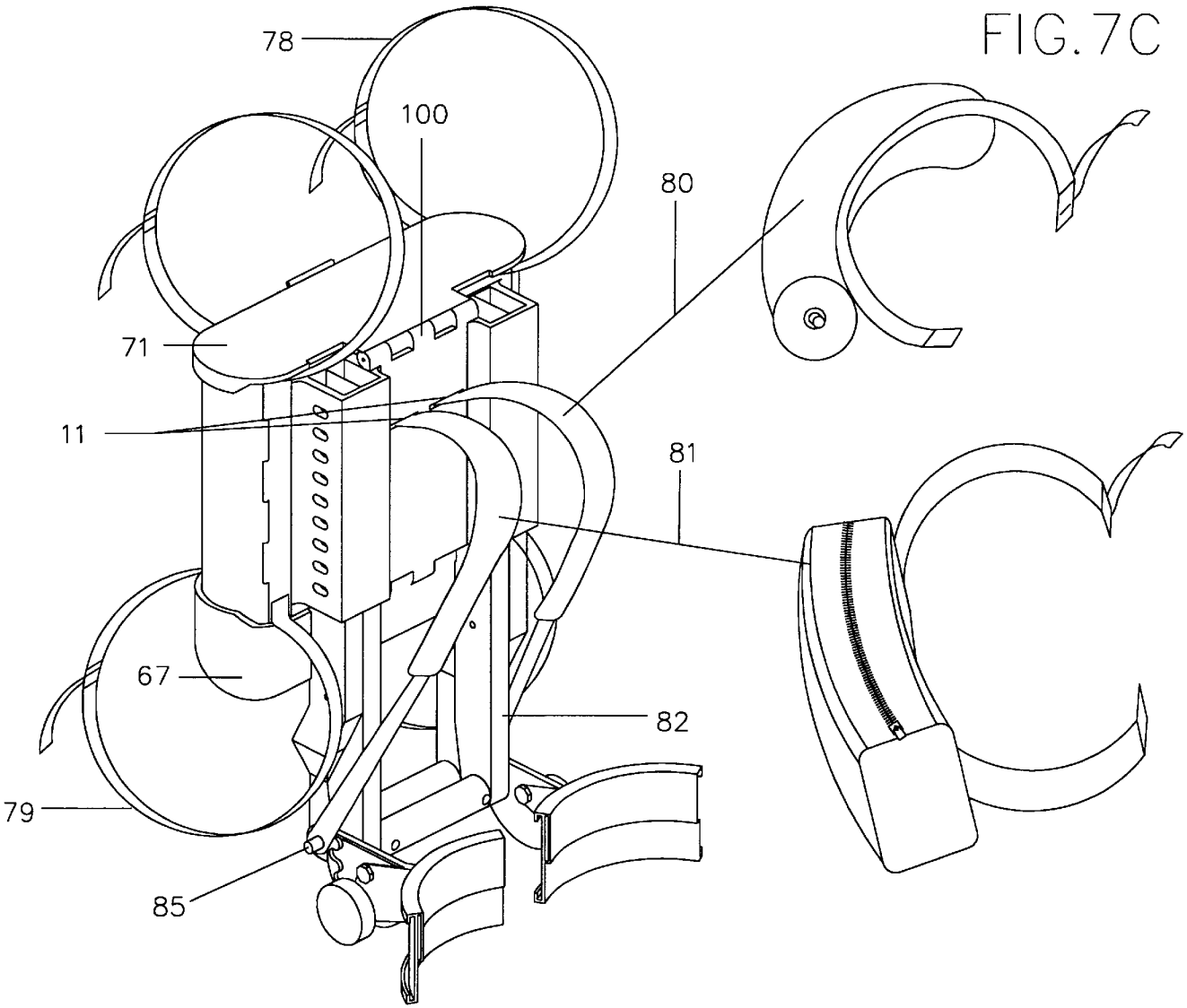
FIG. 7C shows the straps of the backpack and the shoulder straps alternate uses.

Seen in FIG. 7C are the straps and frame of the backpack required for the means of transport. The frame (82) includes structural mounts (85), for releasable and pivotal attachment to both the shoulder straps (described in this paragraph) and to the hip suspension devices described in detail later. The frame (82) is described in further detail later. Both the left and right shoulder straps (80,81), respectively, are releasably attached at their upper ends to the main hull (100) through use of the areas (11), on their respective sides and to the frame (82) at their lower ends by use of the structural mounts (85). Both the left shoulder strap (80) and the right shoulder strap (81) serve dual uses. The left shoulder strap (80) after being detached from the main hull (100) and the frame (82) contains the means to be unfolded, revealing a water reservoir that may then be worn around the waist. The right shoulder strap (81) after being detached from the main hull (100) and the frame (82) contains the means to be unfolded, revealing a fanny pack that may then be worn around the waist. The backpack is equipped with both top and bottom cargo straps (78,79), respectively, which allow dual use cargo bags (described in detail later), to be attached to either end of the backpack. The top straps (78) are attached to the back of the main hull (100) and to the front of the top lid (71). The top straps (78) allow one of two dual use cargo bags (described later), to be attached to the top of the pack with ease. The bottom straps (79) are attached to the back of the main hull (100) and to the front of the bottom lid (67). The bottom straps (79) allow one of two dual use cargo bags (described later), to be attached to the bottom of the pack with ease.

Figure 8A:
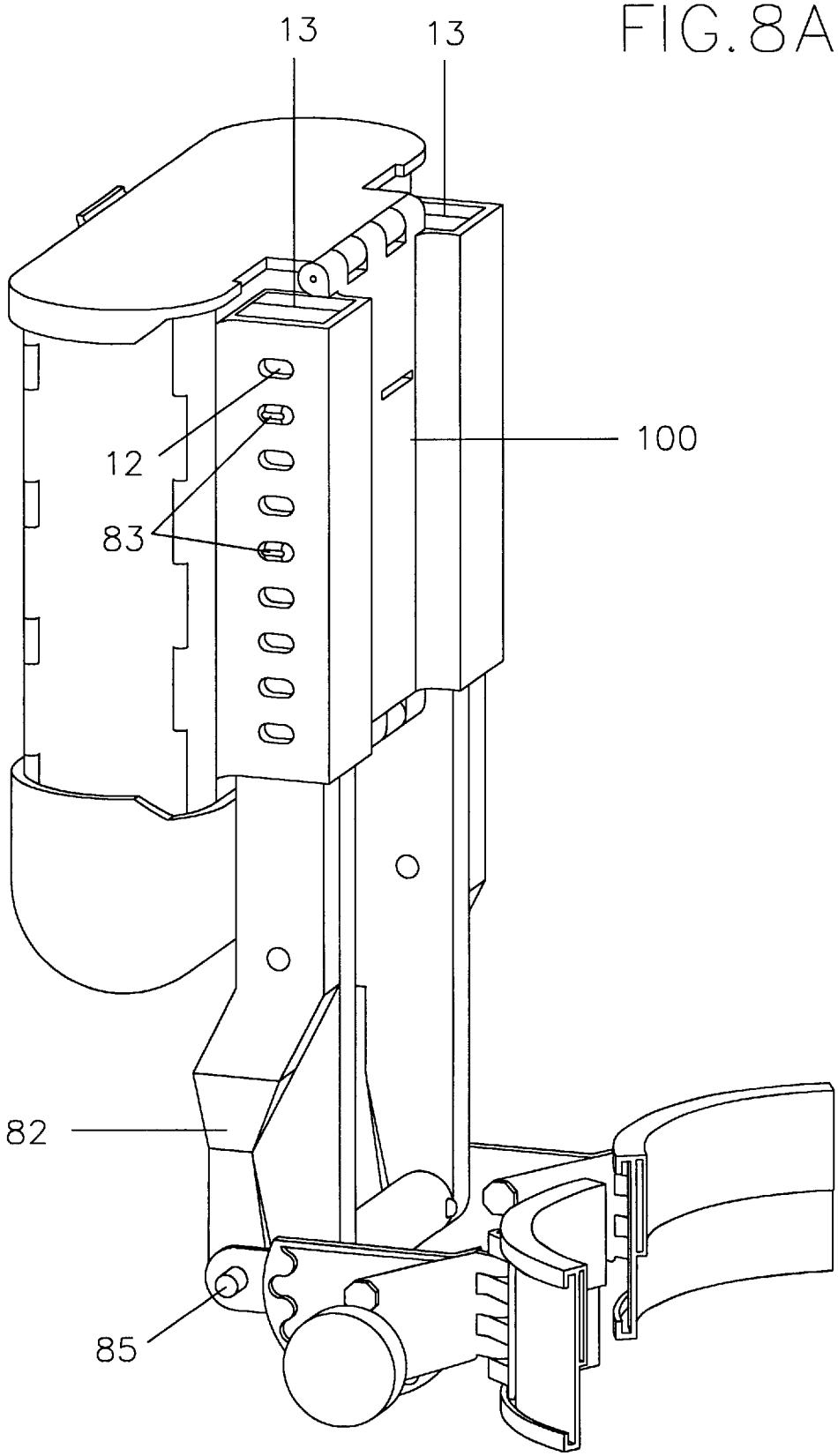
FIG. 8A shows the backpack and frame assembled.

As seen in FIG. 8A, the backpack is assembled with the frame (82) inserted into the main hull (100) through the tubular opening (13). The frame (82) includes adjusting pins (83). The adjusting pins (83) serve to allow the frame (82) to be releasably attached to and from the main hull (100). The adjusting pins (83) also allow the frame (82) to be adjustable within the main hull (100). The adjusting pins (83) protrude through, and are adjustable by the variations of areas (12) within the main hull (100). The frame (82) also includes structural mounts (85) for the releasable and pivotal connection of both shoulder straps (80,81) (as seen in FIG. 7C) as-well-as the hip suspension devices that are described in detail later.

Figure 8B:
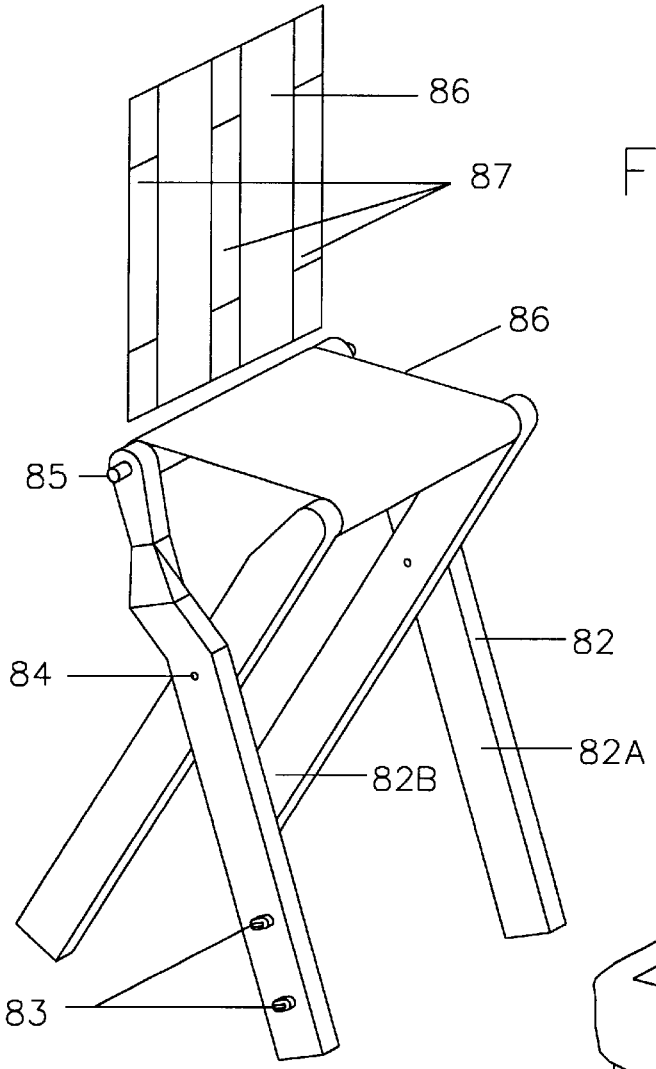
FIGS. 8B and 8C shows the frame of the backpack and its alternate uses.

Seen in FIG. 8B, is an illustration of the second function of the frame (82). The frame (82) after being detached from all other components, contains the means for its shape to be altered by pivoting around the axis (84) to then reveal a device utilized to be sat upon such as a chair. The frame (82) includes structural mounts (85) for the removable and pivotal connection of both shoulder straps (80,81) (as seen in FIG. 7C) as-well-as the hip suspension devices that are described in detail later. The frame (82) further includes adjusting pins (83) which serve to allow releasable attachment to and from the main hull (100) (as seen in FIG. 8A). The adjusting pins (83) also allow the frame (82) to be adjustable within the variations of apertures (12) of the main hull (100) (as seen in FIG. 8A). The top (86) contains means to be releasably attached to the frame (82) for allowing the top to form the seat portion of the chair. The top (86) uses wide stripes of loop and hook fasteners labeled (87) and are sewn to the under side of the top (86) that allows releasable attachment to the frame (82). The frame (82) is formed from two U-shaped frame members (82A, 82B) which are pivotally connected at an axis (84). The legs of the U-shape frame members overlap when pivoted together at axis (84) to allow the frame (82) to be inserted into the tubular opening (13) of the main hull (100).

Figure 8C:
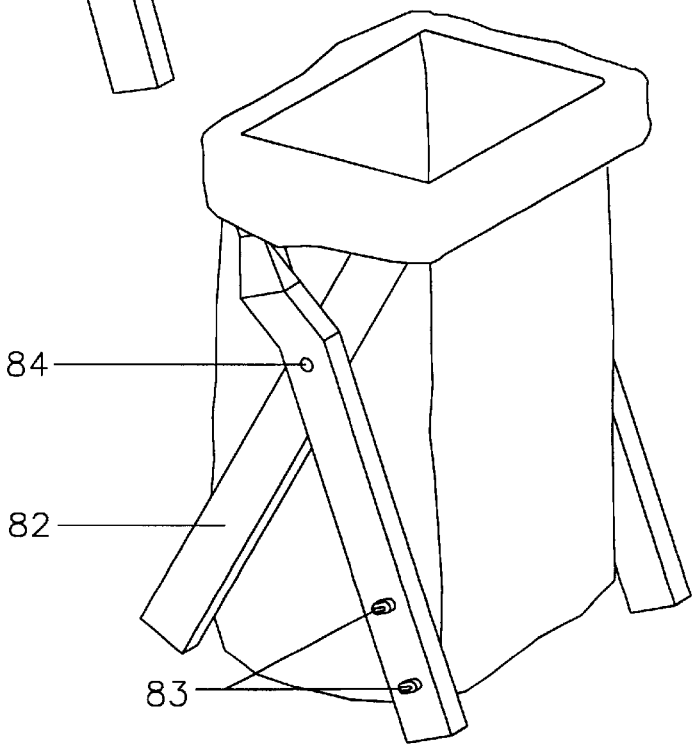

Seen in FIG. 8C, is an illustration of the third function of the frame (82). The frame (82) may be used as a toilet by removing its top (86) and inserting a disposable plastic trash bag.

Figure 9A:
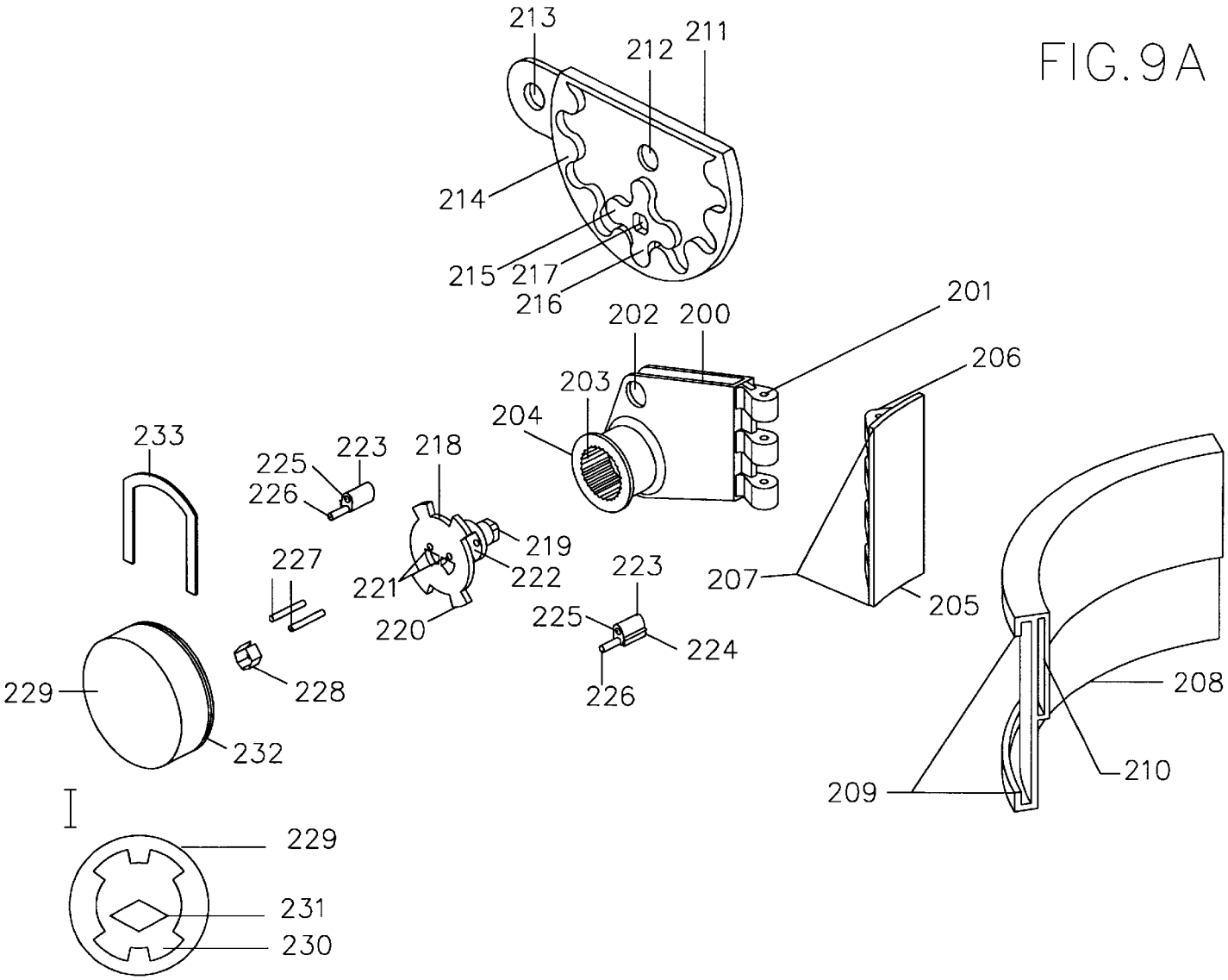
FIG. 9A shows the components of the hip suspension devise.

As seen in FIG. 9A, the components of the hip suspension devices are illustrated. The main body (200) consists of structural mounts (201) for the pivotal connection of a pivotal track that is described in detail later. The main body (200) includes a bolt hole (202) for the pivotal connection of a pivotal gear that is described in detail later. The main body (200) further includes a spline cylinder (203) within which a carrier rotates and by which two cams function (both the carrier and cams are described in detail later). The main body (200) also includes a lip (204) for the attachment in a rotating manner of a control dial that is described in detail later.

The pivotal track (205) consists of structural mounts (206) for the pivotal attachment to the main body (200). The structural mounts (206) allow the pivotal track (205) to be pivotally connected to the main body (200) by use of the structural mounts (201). The pivotal track (205) also include slides (207) for the sliding attachment of a hip plate that is described in detail later.

The hip plate (208) consists of slides (209) for the sliding attachment to the pivotal track (205). The slides (209) allow the hip plate (208) to be mounted in a sliding manner to the pivotal track (205) through use of the slides (207). The hip plate (208) also includes a belt loop (210) for the insertion of a belt, so as to be attachable to a person.

The pivotal gear (211) consists of a bolt hole (212) for the pivotal attachment to the main body (200). The bolt hole (212) allows the pivotal gear (211) to be pivotally connected to the main body (200) through the use of the bolt hole (202) through the means of a bolt. The pivotal gear (211) further includes a mount hole (213) for the pivotal and releasable attachment to the frame (82) (as illustrated and described later). The pivotal gear (211) further includes gear teeth (214) to mesh with a drive gear that is described in detail later.

The drive gear (215) comprise of gear teeth (216) to mesh with the gear teeth (214) of the pivotal gear (211). The drive gear (215) also include a mount hole (217) for the connection of a carrier that is described in detail later.

The carrier (218) comprises a peg (219) for connection to the drive gear (215). The carrier (218) is directly connected to the drive gear (215) by inserting the peg (219) of the carrier (218) into the mount hole (217) of the drive gear (215). The carrier (218) also includes ears (220) for interaction with a control dial (both the dial and this interaction are described in detail later). The carrier (218) also includes mount holds (221) for the pivotal attachment of cams that are described in detail later. The carrier (218) further includes areas (222) that are symmetrical, within which cams (that are described in detail later) are pivotally mounted.

The cams (223) are comprised of spline teeth (224) that allow the hip suspension device as a whole to lock. The cams (223) also include mount holes (225) for pivotal mounting within the carrier (218). The cams (223) further comprise of pegs (226) that protrude into a control dial (that is described in detail later) which control the cams (223) (this action is described in detail later). The cams (223) are placed within the carrier (218) within the areas (222). Pivot pins (227) allow pivotal attachment to the cams (223) within the carrier (218) by being inserted through the mount holes (221) and protruding through the mount holes (225) of the cams (223).

With the cams (223) mounted in place, the carrier (218) is complete, then is inserted into and rotates within the spline cylinder (203) of the main body (200). The carrier (218) is directly connected to the drive gear (215). The peg (219) of the carrier (218) is inserted into the mount hole (217) of the drive gear (215). In this manner the carrier (218) keeps the drive gear (215) in such a position that the gear teeth (216) of the drive gear (215) stay in constant contact with the gear teeth (214) of the pivotal gear (211).

The spring (228) sets within a control dial that is described in detail later. The spring (228) is placed in such a manner as to be in constant contact with the pegs (226) of the cams (223). The spring (228) serves to press against the pegs (226) of the cams (223) in such a manner that spreads further apart the cams (223), this action is described in further detail later.

The control dial (229) comprise of areas (230) (as seen in view I) that allow the control dial (229) to fit onto and contact the carrier (218), this action is described in detail later. The control dial (229) further includes a void (231) within which the spring (228) is placed, and into which both pegs (226) of the cams (223) protrude into. The void (231) within the control dial (229) manipulates the cams (223), this action is described in detail later. The control dial (229) also includes a slot (232) for the insertion of a keeper that is described in detail later.

The keeper (233) attaches the control dial (229) to the main body (200) in a rotating manner as follows. When all other components are in place, the control dial (229) is placed onto the carrier (218) the slot (232) of the control dial (229) is then behind the lip (204) of the main body (200), the keeper (233) is then inserted into the slot (232) of the control dial (229) and the device is complete.

Figure 9B:
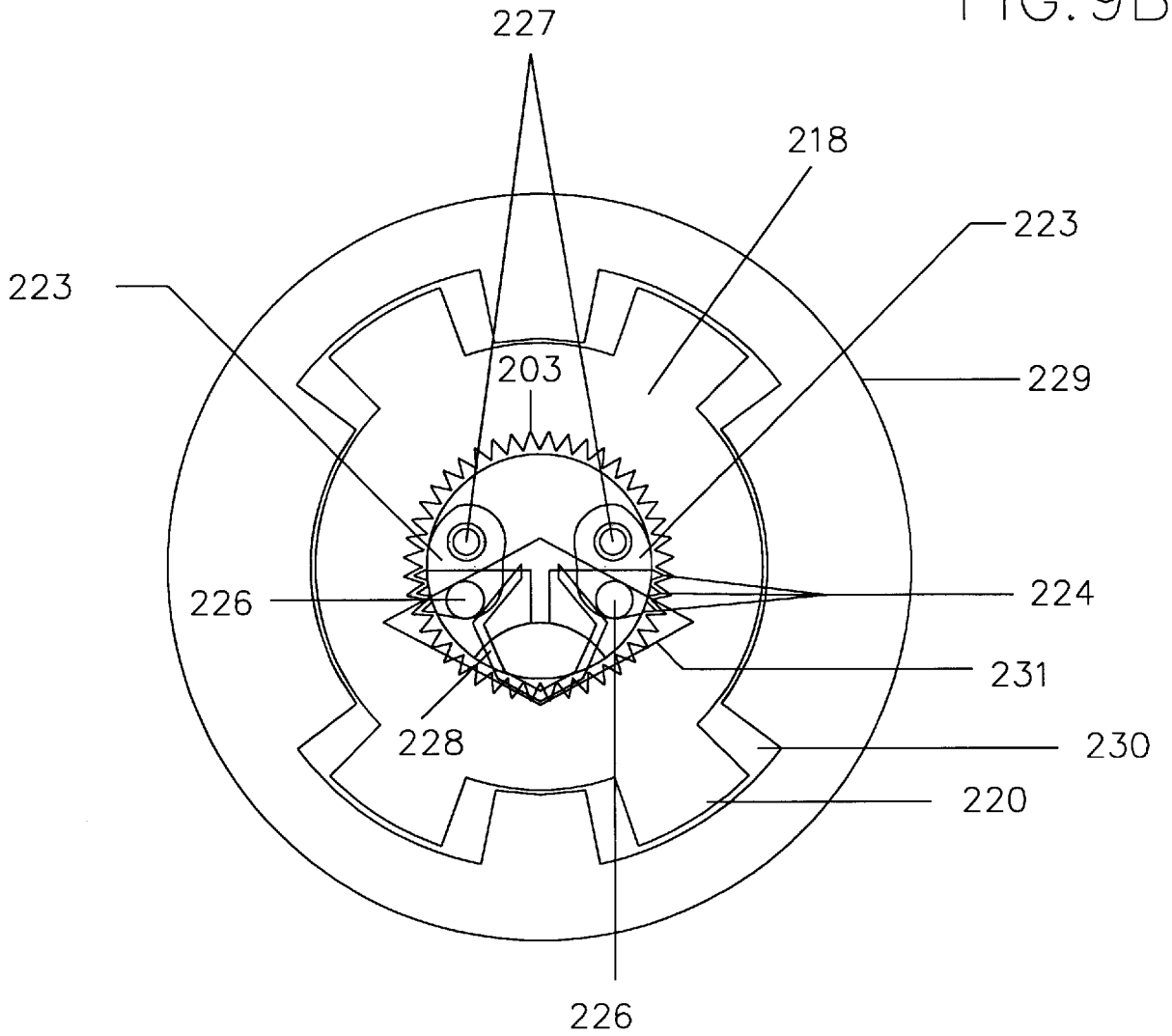
FIG. 9B shows the internal components of the hip suspension devise assembled.

As seen in FIG. 9B, the components, carrier (218), cams (223), spring (228) and control dial (229) of the hip suspension device as described in FIG. 9A, are assembled in a view as though the control dial (229) was transparent and an articulating ratchet action described. All other components are deleted for simplicity of viewing. The dial (229) is the control by which a person controls the hip suspension device as a whole. The control dial (229) houses a spring (228) within the area (231). Both pegs (226) of the cams (223) protrude into the area (231) of the control dial (229) and contacts the spring (228) housed within. When the suspension device as a whole is locked, the spring (228) exerts force on both pegs (226) of the cams (223) in such a manner that pushes the spline teeth (224) of the cams (223) into the spline cylinder (203) thereby the device as a whole is locked in a given position. The cams (223) are pivotally mounted within the carrier (218) by use of the pivot pins (227). The cams (223) are mirror copies of each other, although serving the same function they work in opposing directions. Each of the cams (223) will rotate freely inside the spline cylinder (203) while the spline teeth (224) (of one cam (223)) are in contact with the spline cylinder (203). Each of the cams (223) rotates freely in a deferent direction; and refuses the opposite direction (hence the term ratchet). While one of the cams (223) would be free to ratchet in a given direction the opposite cam (223) is arranged to oppose that direction thereby each locks the other. Therefore, to change the position of the hip suspension device as a whole, one of the cams (223) must be moved to a position where the spline teeth (224) (of one cam (223)) are not in contact with the spline cylinder (203).

The following narration of action describing the function of this device is relative to the illustration and view of FIG. 9B, when referring to right/left components and directions. The control dial (229) controls the position of the cams (223). As the control dial (229) is turned in a clockwise direction the area (231) within the control dial (229) contacts the peg (226) of the right cam (223) which is pivotally mounted on one pivot pin (227) within the carrier (218) moving the spline teeth (224) of said right cam (223) out of contact with the spline cylinder (203). At the same time that the spline teeth (224) (of said right cam (223)) are separated from contact with the spline cylinder (203), the areas (230) of the control dial (229) contact the ears (220) of the carrier (218). As the control dial (229) is turned to a desired position (still holding said right cam (223) out of contact with the spline cylinder (203)), the carrier (218) is turned, (rotating both cams (223)); the cam (223) on the left hand side simply ratchets around the spline cylinder (203). When the desired position is achieved the control dial (229) is released. At that instant, the spring (228) shoves said right cam (223) back into the locked position. If the control dial (229) is turned in a counterclockwise direction the process would be in reverse. In this manner the device functions.

Figure 9C:
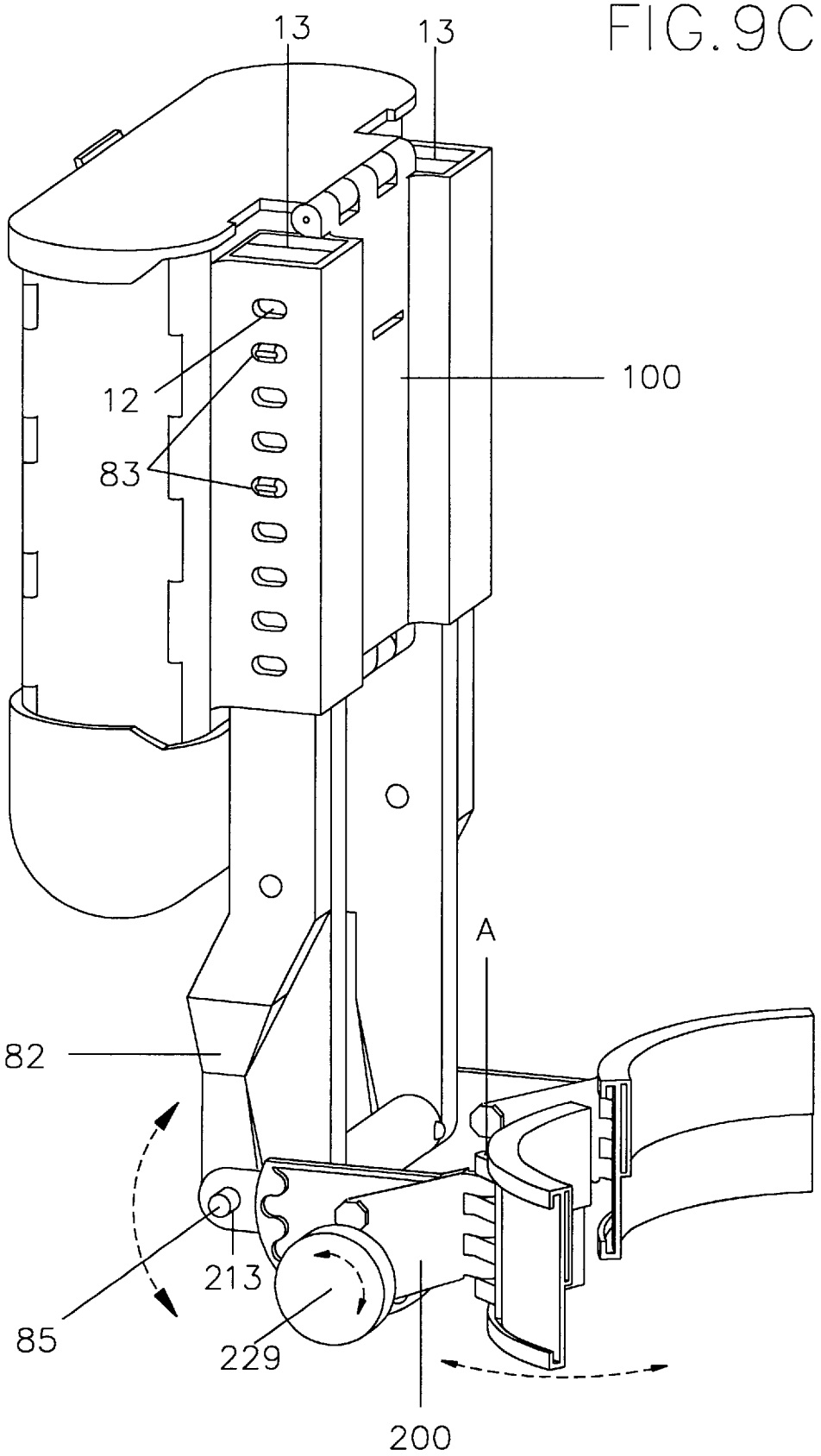
FIG. 9C shows the backpack assembled with the frame and hip suspension devices.

As seen in FIG. 9C, the hip suspension devices (200) are pivotally connected to the frame (82). The hip suspension devices (200) are pivotally connected through the use of the mount hole (213) to the frame (82) by the use of the structural mounts (85). In a pivotal manner hip suspension devices (200) conform to the contours of the human waist line around the axis marked (A), as indicated by the broken line beneath it. The hip suspension devices (200) provides the means to allow weight distribution of the backpack to be altered through an articulating ratchet action (as described in FIG. 9B), controlled by the control dial (229) in a semi circular motion as indicated by the broken line to the rear of the hip suspension devices (200). The wearer can raise or lower the backpack during transport altering the interaction of weight to the body for greater comfort.

Figure 10A:
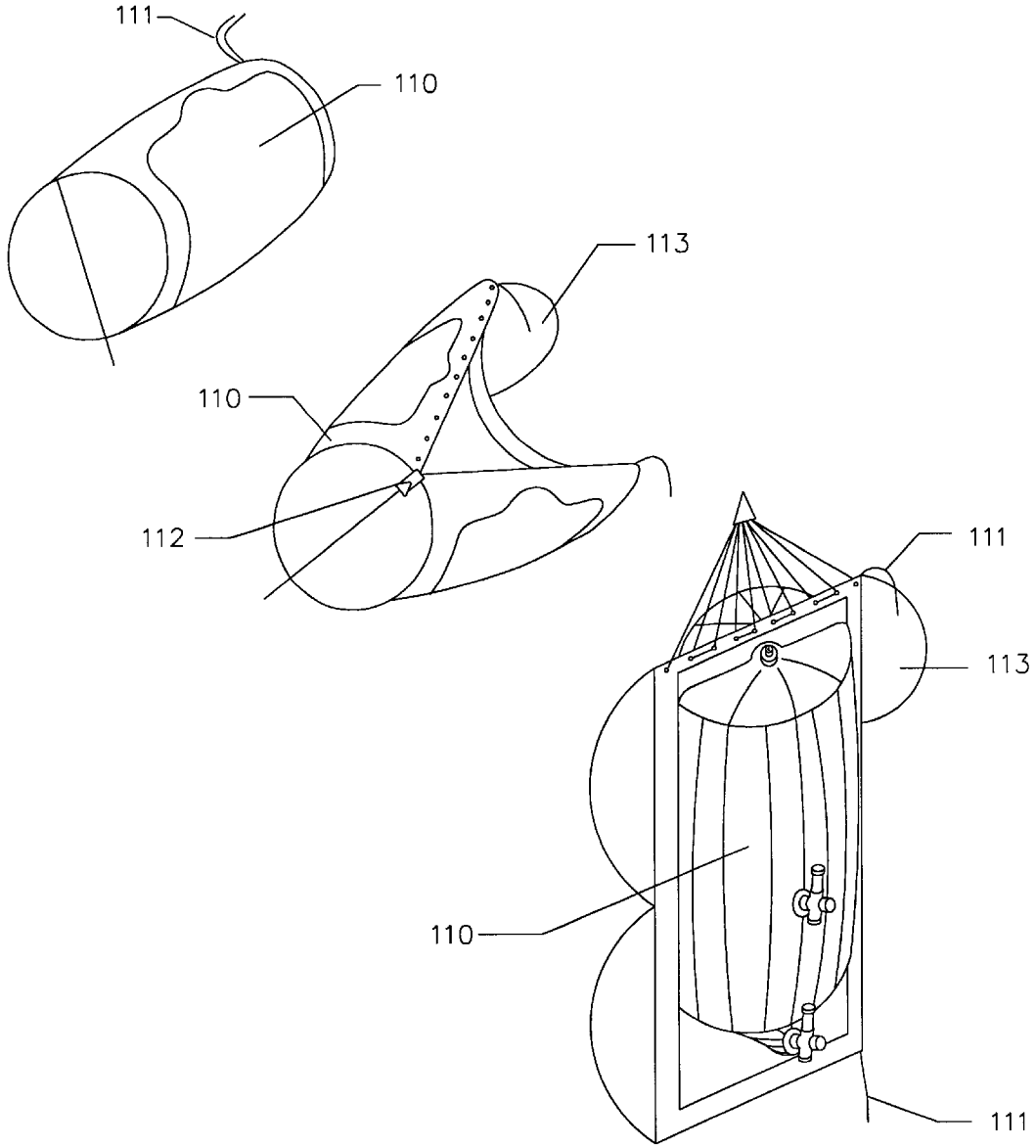
FIG. 10A shows one of two dual purpose bags transforming to their alternate form.

Seen in FIG. 10A, is one of two identical dual use bags (110) which serve two functions. To describe one, is to describe both; Hence one of the two bags (110) is illustrated and described as being plural.

As seen in the illustrations of FIG. 10A, the bags (110) are capable of having there form altered to serve one function during transport and a second function with the water system that is described in detail later. As seen in FIG. 10A, the bags (110) in their cargo form both resemble and function as a common stuff sack. One of the bags (110) in cargo form is used to store for transport clothes and the second bag (110) is for storing a sleeping bag in such a manner as they would be transported on the back. Each of the bags (110) in cargo form, is attached to one end of said backpack by use of said cargo straps (78,79) as described in FIG. 7C. The bags (110) comprise of draw straps (111). The draw straps (111) are the means by which equipment, such as clothes and a sleeping bag are secured within the bags (110), in cargo form, for storage during transport as they would be carried on the back. The bags (110) are equipped with zippers (112) seen in FIG. 10A, The zippers (112) are the means by which the bags (110) alter form. The bags (110) are also provided rain flaps (113). The rain flaps (113) aide in preventing rain from corrupting equipment such as clothes and a sleeping bag contained within the bags (110) in cargo form during transport. The bags (110) after being emptied, are unzipped by use of the zippers (112) to reveal their reservoir form, seen in FIG. 10A, used to store water for the water system that is described in detail later.

Figure 10B:
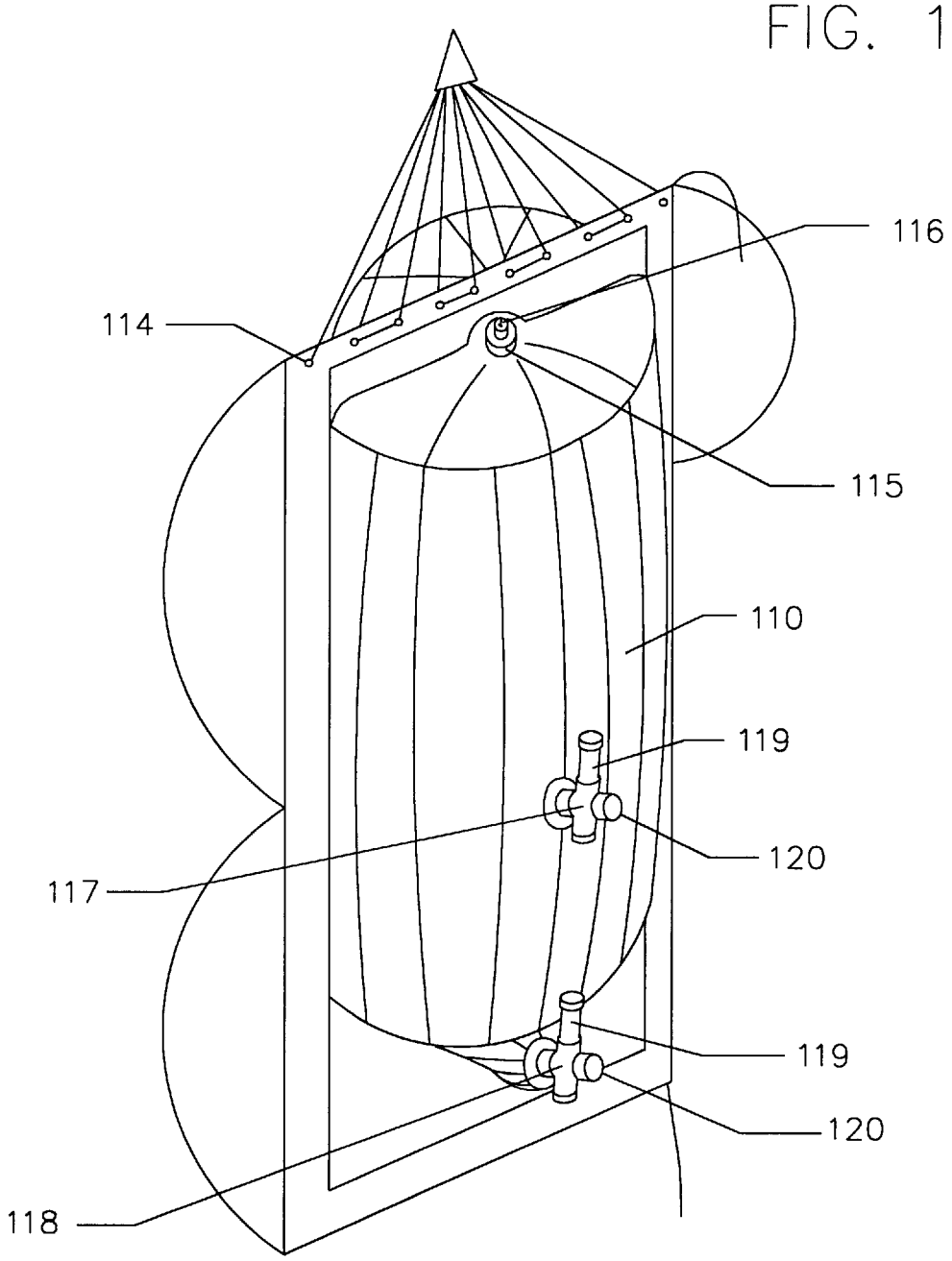
FIG. 10B shows the alternate form of the dual purpose bags.

As seen in FIG. 10B, the bags (110) in reservoir form expose elements relative to their function with the water system (that is described in detail later). A water proof sack is constructed within the liners of the bags (110) used to contain water. The bags (110) are further provided grommets (114). The grommets (114) allow the bags (110), in reservoir form, to be suspended in the air supporting the weight of water contained within the same. The bags (110) are also provided filler caps (115). The filler caps (115) are the means by which the bags (110) in reservoir form, are filled with water. The filler caps (115) comprise of an integrated air valves (116). The air valves (116) provide a passage for air to enter and exit the bags (110) in reservoir form, relative to use, this action is described in detail later. The bags (110) are further equipped with upper and lower valve bodies (117, 118), receptively. Both the upper valve body (117) and the lower valve body (118) includes valves (119). The valves (119) are the means by which water is retained or released relative to use, this is described in detail later. Both the upper valve body (117) and the lower valve body (118) further includes fittings (120). The fittings (120) are the entities by which the upper valve body (117) and the lower valve body (118) are mechanically connected to water lines, described in detail later.

Figure 10C:
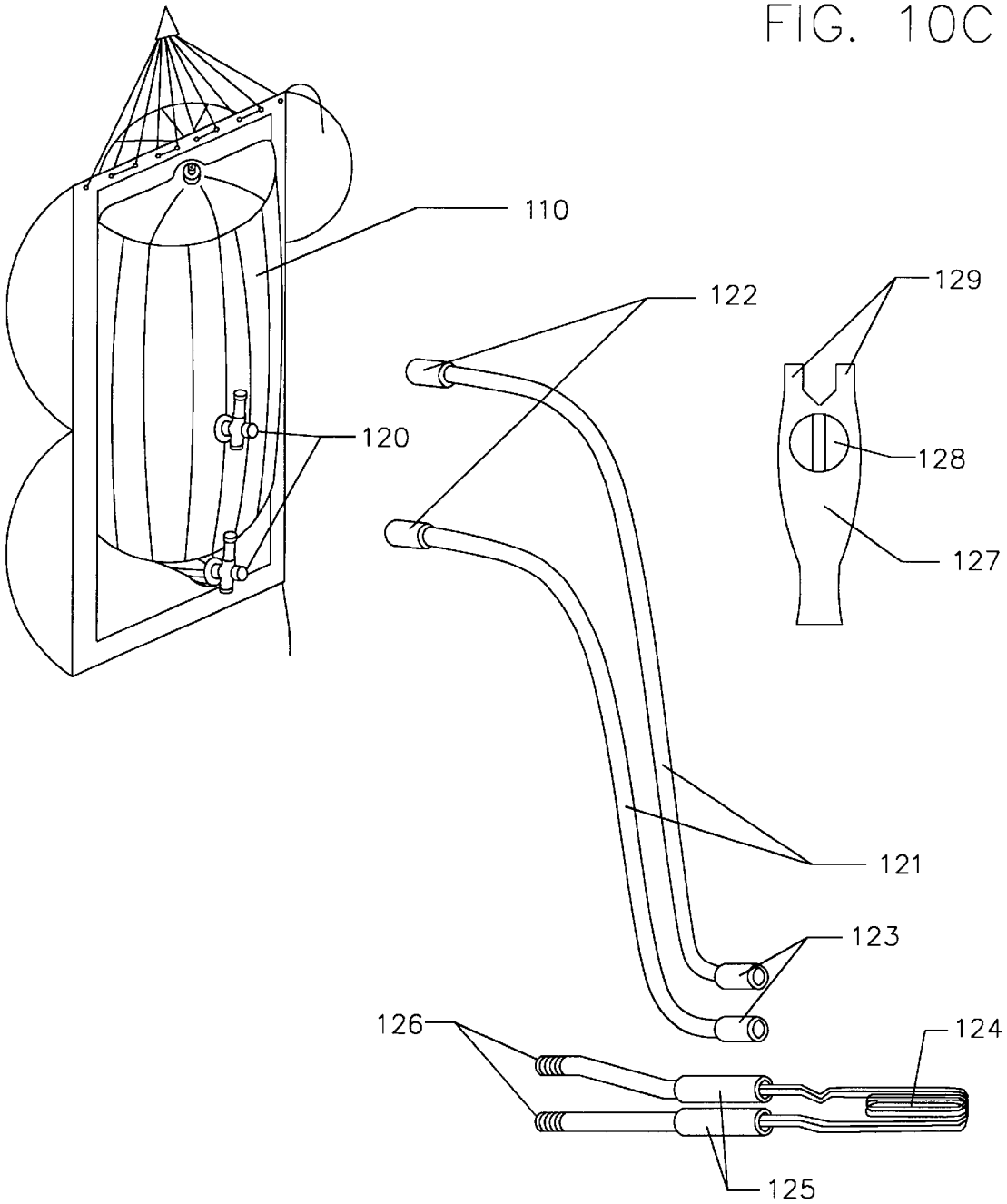
FIG. 10C shows components of the shower system; one of two bags, the water lines, heater core and a shower head.

As seen in FIG. 10C, water lines, a heater core and a shower head complete a water heating shower system, that is adjustable in temperature containing both hot and cold attributes (this is described in further detail later). The water lines (121) provide water a passage from one of the bags (110) in reservoir form, to a heater core (described in this figure) and back to the bag (110), for the purpose of heating water, the heating process is described in detail later. The water lines (121) also provide water a passage from both bags (110) in reservoir form to a shower head, (described in this figure later), for the purpose of dispersing water, this process is described in detail later. The water lines (121) comprise both top and bottom fittings (122,123), respectively. The top fittings (122) are the entities by which the water lines (121) are mechanically connected to the bags (110) in reservoir form, by use of the fittings (120). The bottom fittings (123) are the entities by which the water lines (121) are mechanically connected, relative to use, to either a heater core or a shower head, as described in this figure later.

The heater core (124) contains the means to absorb heat from a heat source for the purpose of heating water, this process is described in detail later. The heater core (124) comprises of three separate loops of hollow metal tubes which absorb heat. The heater core (124) is further provided with expansion chambers (125). The expansion chambers (125) provide an area for steam, created by the heating process to be dispersed back into the water, this process is described in detail later. The heater core (124) further includes fittings (126). The fittings (126) are the entities by which the heater core (124) is mechanically connected to the water lines (121) by use of the bottom fittings (123).

The shower head (127) is used to disperse water. The shower head (127) comprises a valve (128) which controls water flow as off/on and adjusts the temperature of the water ejected. The shower head (127) also includes fittings (129). The fittings (129) are the entities by which the shower head (127) is mechanically connected to the water lines (121) by use of the bottom fittings (123), for the purpose of dispersing and controlling water this process is described in further detail later.

Figure 10D:
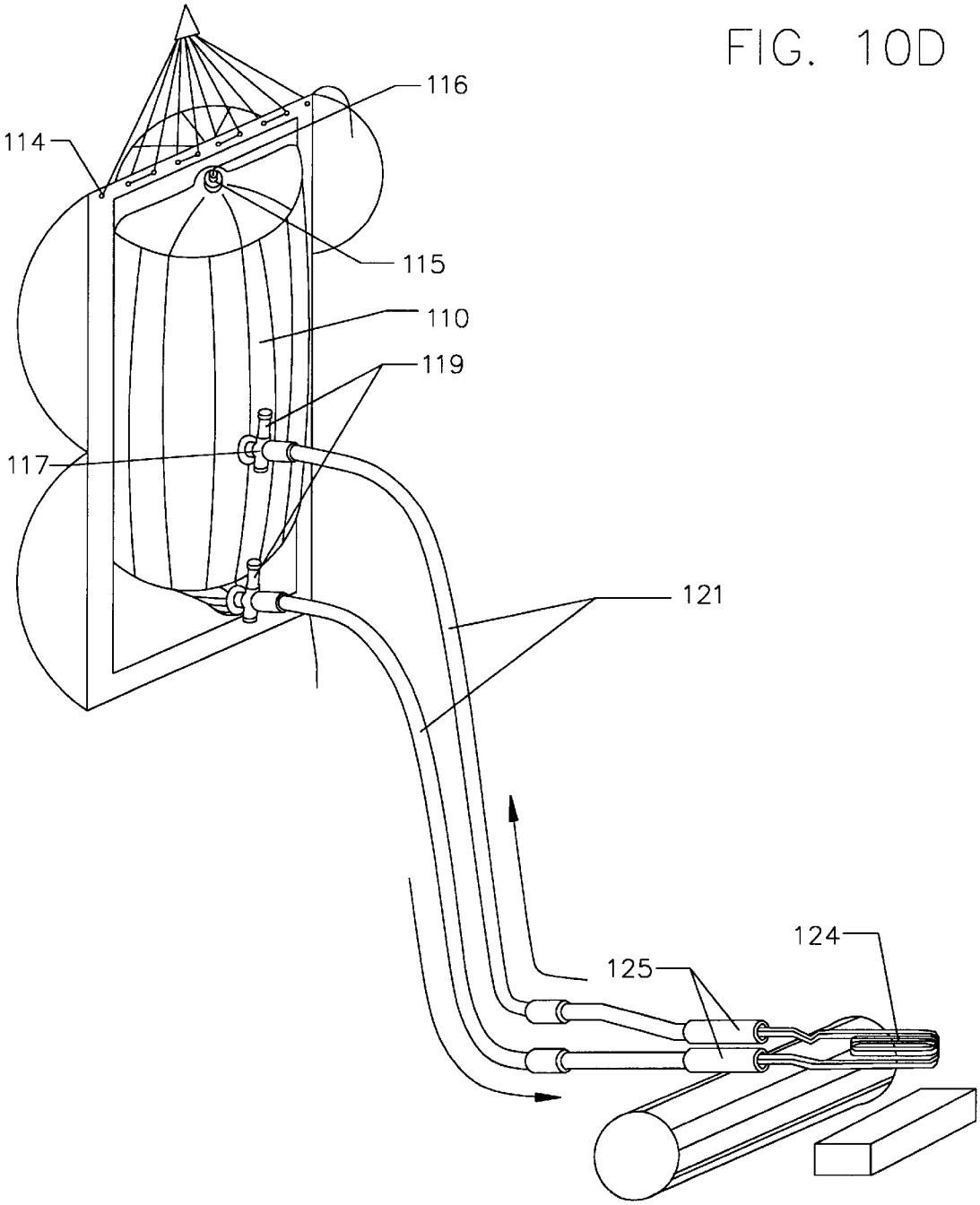
FIG. 10D shows one bag, the water lines and heater core in a configuration as they are during the heating process.

As seen in FIG. 10D, the operation of the heating process. One of the two bags (110) with the valves (119) closed, is filled with water, through the means of the filler cap (115), to any level above the upper valve body (117); then suspended in the air about waist high by use of the grommets (114). The bag (110) is then connected to the heater core (124), through use of the water lines (121) as described in FIG. 10C. The air valve (116) and the valves (119) are then opened. Gravity allows the water lines (121) and the heater core (124) to be filled with water and the heater core (124) is then introduced into direct contact with any exposed heat source for example a camp stove, grill, fire exc. The heater core (124) transfers heat from the heat source to the water contained within itself As the water within the heater core (124) is heated approaching the boiling point it expands, creating pressure which forces the water to move in the path of least resistance, which is through the upper water line (121) and back into the bag (110). This action simultaneously creates a void within the heater core (124), which draws cooler water in, as a siphon action, from the bag (110) through the bottom water line (121) into the heater core (124) in relevant volume to the water that has been displaced. This process is then repeated and continues as a constant cycle as long as the heater core (124) is in contact with any exposed heat source. Steam which is created by this process interferes with the circulation of water flow. The heater core (124) is equipped with expansion chambers (125) which minimizes interference created by steam. The expansion chambers (125) provides an area, larger than that of the heater core (124), which allows the steam to expand there by being dispersed throughout a larger volume of water, thus enhancing circulation of the water flow. Steam which invades the bag (110) during the heating process builds pressure that must be relieved. The air valve (116), which is integrated into the filler cap (115), provides a passage for steam to exit the bag (110).

After water within the bag (110) has been thoroughly heated, the heater core (124) is removed from the heat source. The valves (119) are then closed and the heater core (124) is disconnected from the water lines (121).

Figure 10E:
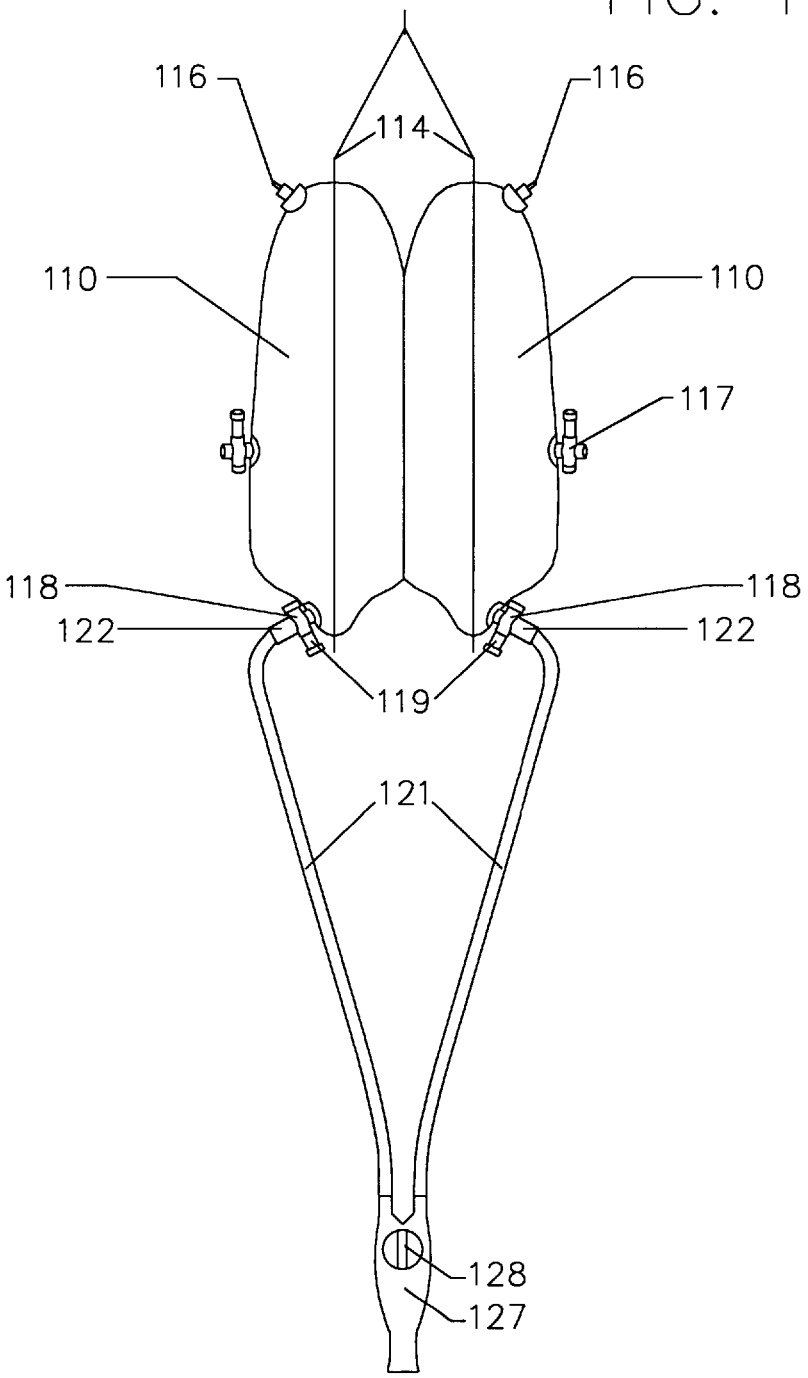
FIG. 10E shows the shower system ready for use.

As seen in FIG. 10E, the water system after heating is ready for use. Both bags (110) are suspended in the air side-by-side, by use of their respective grommets (114). One of the bags (110) contains water that has been heated and the second bag (110) contains water of natural temperature, (cold). The upper water line (121) as sees in FIG. 10D, is detached from the upper valve body (117) of the heated bag (110) and is mechanically connected to the lower valve body (118) of the natural bag (110) by use of the fittings (122). The water lines (121) are then mechanically connected to the shower head (127) as described in FIG. 10C. Both air valves (116) are opened, then the valves (119) of the lower valve bodies (118) are opened. The shower head (127) comprises a valve (128). The valve (128) is the means by which the user controls the flow of water as off/on and allows the user to control a mixture, in any ratio, of water from both bags (110) to regulate and adjust, as desired, the temperature of the water ejected. As water is drained from the bags (110), the air valves (116) provides air a passage to enter the bags (110) there by increasing water flow.

I claim:

1. A backpack assembly for enclosing and carrying items on the back of a wearer, the assembly comprising:

a rigid main hull forming the portion of the backpack positioned adjacent the back of the wearer having a top edge, bottom edge, and first and second side edges;

rigid first and second outer shells having first and second side edges, the first side edges of the first and second outer shells being pivotally connected to the first and second side edges of the main hull to form first and second hinges;

rigid first and second outer doors having first and second side edges, the first side edges being pivotally connected to the second side edges of the first and second outer shells to form third and fourth hinges;

a rigid top lid being pivotally connected to the top edge of the main hull;

a rigid bottom lid being pivotally attached to the bottom edge of the main hull;

means for securing the main hull, the first and second outer shells, the first and second outer doors, the top lid, and the bottom lid together to form a rigid container with the second edges of the first and second doors being placed adjacent each other;

first and second inner cylinders being pivotally connected with the third and fourth hinges respectively and positioned inside the formed container for holding articles inside the backpack;

means for securing the container to the back of the wearer.

2. The backpack of claim 1 further comprising:

first and second inner doors, pivotally connected to the main hull, having pockets for carrying additional articles inside the container.

3. The backpack of claim 1 further comprising:

upper and lower interlocking compartments slidingly attached to the main hull inside the container.

4. The backpack of claim 1 further comprising:

first and second outer pockets attached to an outside surface of the container and being removable from the container and having means to connect the pockets together for forming a sack useable off the backpack for storing equipment while camping.

5. The backpack of claim 1 wherein the means for securing the container to the back of the wearer includes a pair of shoulder straps which are convertible into waist attached article carriers.

6. The backpack of claim 1 further comprising:

a water heating shower system having two dual use bags with water holding bladders attachable to the backpack, two removable water lines, a heater core, and a shower head; the bags having a closure fastener to allow the bags to be closed for allowing articles to be carried inside the bag on the backpack and to be opened for allowing the bags to be used as water reservoirs; the water lines are rearrangable to allow the lines to be connected to one of the bags and the heater core to allow the water in one of the bags to be heated or to allow each of the water lines to be connected to a different one of the water bags and both to the shower head to allow the system to be used as a shower.

7. A backpack assembly for enclosing and carrying items on the back of a wearer, the assembly comprising:

a rigid main hull forming the portion of the backpack positioned adjacent the back of the wearer having first and second backrests, a panel member having first and second edges, and first and second side walls; the first and second backrests having an inner wall, a front wall, an outer wall, and a rear wall to form a vertical tube; the panel member attached between the first and second backrests with each of the first and second edges of the panel member attached to the inner wall of one of the first and second backrests, each of the first and second side walls being attached to one of the outer walls of the first and second backrests, the tubular backrests further including a plurality of vertically spaced apertures positioned on the outer wall of each of the backrests;

a frame formed from two U-shaped frame members, the two U-shaped frame members having legs which pivotally connect together to allow the legs to overlap with each other to allow the legs to be inserted into the vertical tubes of the first and second backrests, the legs of one of the U-shaped members each having a pin positioned at one end and a mount at the other end, the pins engagable with the plurality of vertically spaced apertures for retaining the frame in the main hull and allowing for adjustment between the frame and main hull, the two U-shaped frame members being openable to allow the frame to be used as the support structure of a seat or toilet when removed from the main hull;

means for carrying articles on the main hull;

a pair of shoulder straps, each having a first end attached to the main hull and a second end attached to the mount for securing the backpack to the user;

and an adjustable hip suspension device attached to the mounts of the one of the U-shaped members.

8. The backpack of claim 7 wherein the adjustable hip suspension device includes a main body forming the base structure of the device, a pivotal track pivotally mounted to the main body, a front plate having means for slidingly mounting the plate to the track, the front plate further having a belt loop, a waist belt secured through the belt loop for attaching the backpack around the waist of the wearer, a pivotal gear pivotally mounted to the main body and further having a mount hole for attaching the pivotal gear to the mounts of the frame, a drive gear for moving the pivotal gear relative to the main body, a control dial for adjusting the adjustable hip suspension device, a carrier for connecting the control dial to the drive gear, two cams for locking the hip suspension device in position having hinge pins for pivotally mounting the cams within the carrier, a spring positioned within the carrier for maintaining the cams in their locking position, and a keeper for retaining the control dial to the main body in a manner to allow the control dial, carrier, and drive gear to rotate;

wherein when the user operates the control dial, the pivotal gear is repositioned relative to the main body by the drive gear which provides adjustment of the frame relative to the waist belt.

9. The backpack of claim 7 wherein the pair of shoulder straps are convertible into waist attached article carriers.

* * * * *